US010864432B2

(12) United States Patent
Imai

(10) Patent No.: US 10,864,432 B2
(45) Date of Patent: Dec. 15, 2020

(54) VARIABLE SURFACE GAMING PLATFORM

(71) Applicant: Stu Imai, Rancho Palos Verdes, CA (US)

(72) Inventor: Stu Imai, Rancho Palos Verdes, CA (US)

( * ) Notice: Subject to any disclaimer, the term of this patent is extended or adjusted under 35 U.S.C. 154(b) by 0 days.

(21) Appl. No.: 16/821,889

(22) Filed: Mar. 17, 2020

(65) Prior Publication Data

US 2020/0298098 A1 Sep. 24, 2020

Related U.S. Application Data

(60) Provisional application No. 62/821,265, filed on Mar. 20, 2019.

(51) Int. Cl.
*A63F 3/00* (2006.01)

(52) U.S. Cl.
CPC ..... *A63F 3/00261* (2013.01); *A63F 3/0052* (2013.01); *A63F 3/00643* (2013.01); *A63F 3/00* (2013.01); *A63F 3/0023* (2013.01); *A63F 3/00214* (2013.01); *A63F 2003/0022* (2013.01); *A63F 2003/00217* (2013.01); *A63F 2003/00233* (2013.01); *A63F 2003/00299* (2013.01); *A63F 2003/00324* (2013.01); *A63F 2003/00343* (2013.01); *A63F 2003/00359* (2013.01); *A63F 2003/00394* (2013.01); *A63F 2003/00397* (2013.01); *A63F 2003/00646* (2013.01);

(Continued)

(58) Field of Classification Search
CPC ..... A63F 3/00; A63F 3/00214; A63F 2003/00217; A63F 2003/0022; A63F 2003/00233; A63F 3/0023; A63F 2003/00656; A63F 2003/00646; A63F 2003/00359; A63F 2003/00394; A63F 2003/00397
USPC ..... 273/287, 285, 238, 237, 260, 261, 283
See application file for complete search history.

(56) References Cited

U.S. PATENT DOCUMENTS 343,496 A * 8/1886 Seliger ..... A63F 3/0023 273/282.2
3,880,429 A * 4/1975 Blumenaus ..... A63F 3/0023 273/282.2

(Continued)

FOREIGN PATENT DOCUMENTS

GB 2253610 A * 9/1992 ..... A63F 3/0023

*Primary Examiner* — Benjamin Layno
(74) *Attorney, Agent, or Firm* — Roy A. Ekstrand

(57) ABSTRACT

A game utilizes a multi-surface play surface having a plurality of locations defined thereon. A plurality of topographical features are removably attachable to selected ones of the locations to further alter the game play surface. A surface base supports a plurality of light source nodes interconnected by pluralities of light transmitting elements. Light is directed upwardly through the light source nodes. Additionally, selected portions of the game play surface which overlay on top of a light source node define surface locations which include light transmissive elements constructed to avoid blocking the light therefrom. Selected surface features also include light transmissive elements to further avoid blocking light from the light source node and game play surface location. The surface base is formed in two segments and is supported upon a book-like housing which includes a mechanism for raising and lowering one of the surface base segments within the housing to facilitate complete closure thereof.

9 Claims, 26 Drawing Sheets

(52) U.S. Cl.
CPC ..... *A63F 2003/00652* (2013.01); *A63F 2003/00656* (2013.01)

(56) References Cited

U.S. PATENT DOCUMENTS 3,977,682 A * 8/1976 Aida ..... A63F 3/022
273/237
4,781,384 A * 11/1988 Bois ..... A63F 3/0023
273/285
5,087,050 A * 2/1992 Donovan ..... A63F 3/0449
273/237
5,190,295 A * 3/1993 Togni ..... A63F 3/0023
206/315.1
5,413,352 A * 5/1995 Persidsky ..... A63F 3/00694
273/239
6,286,835 B1 * 9/2001 Quercetti ..... A47B 97/08
273/285
9,345,954 B2 * 5/2016 Christensen, Jr. ..... A63F 9/24

* cited by examiner

Fig 24A
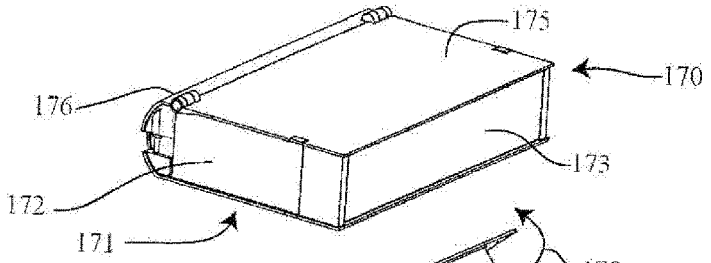
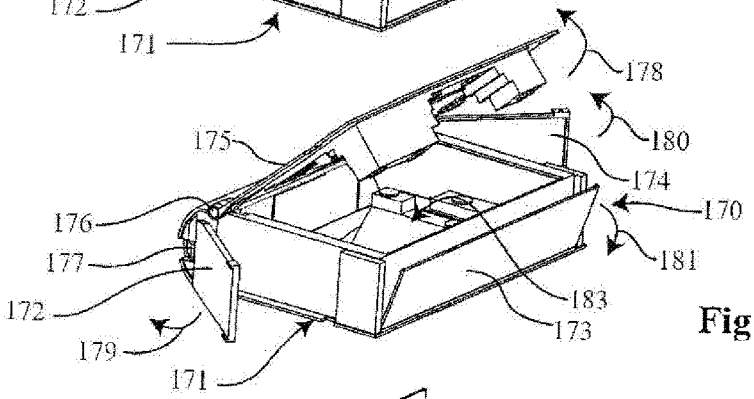
Fig 24B
Fig 24C
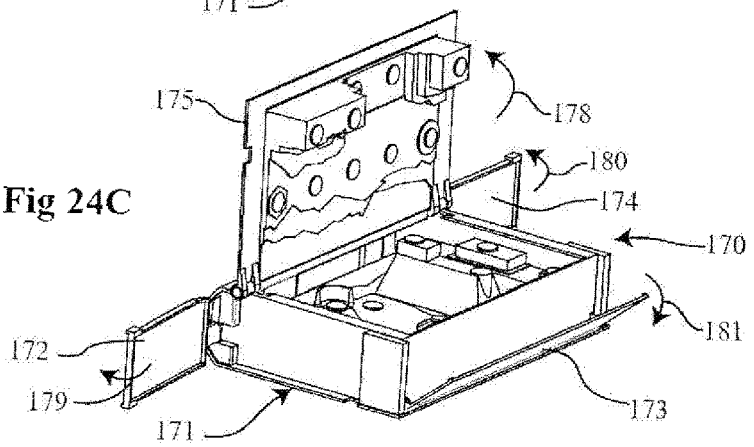
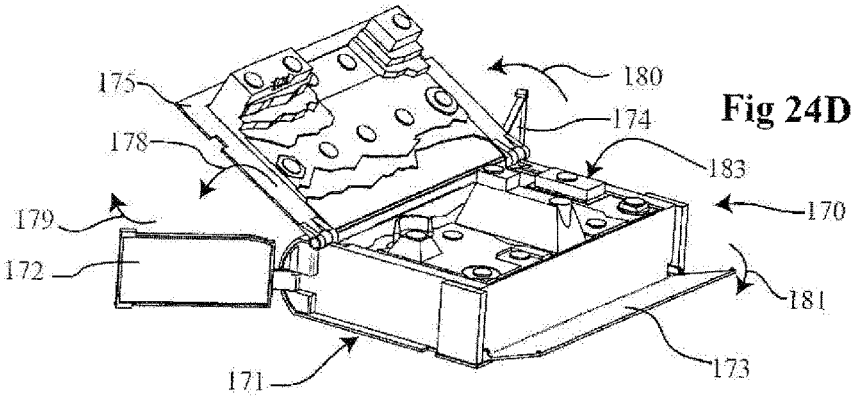
Fig 24D
Fig 24E
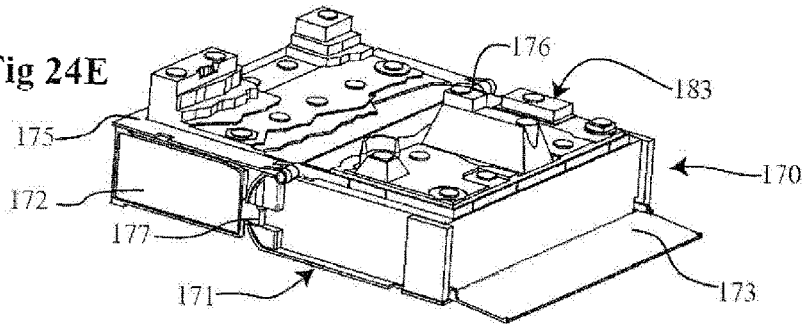

VARIABLE SURFACE GAMING PLATFORM

CROSS-REFERENCE TO RELATED APPLICATION

This application claims the benefit of and priority under 35 U.S.C. 119(e) of U.S. Provisional Patent Application No. 62/821,265 entitled VARIABLE SURFACE GAMING PLATFORM, filed Mar. 20, 2019 in the name of Stu Imai, the disclosure of which is incorporated herein by reference.

FIELD OF THE INVENTION

This invention relates generally to games and particularly to games in which one or more play pieces are moved upon a game play surface.

BACKGROUND OF THE INVENTION

Perhaps one of the most popular and pervasive types of games developed and commercially provided within the game arts may be generally described as "board games" characterized by having a cardboard play surface (game board) which bears various visible indicia usually defining various game events and consequences as well as travel paths defined by game rules. Such board games typically further include a plurality of game pieces, often described as "tokens" which are associated with each game player. Under the game rules the players typically attempt to negotiate the travel of their respective tokens through the various challenges and obstacles defined in the game board play surface. As practitioners in the art have attempted to provide ever-more improved and interesting board games, a virtually endless variety of game play rules and game play boards have been created. In many instances, practitioners seek to design interactive features such as sound, and physical movement which are provided to further enhance the game play excitement.

While the previously provided prior art board games have to some extent improved the art and have in some instances enjoyed commercial success there remains nonetheless a continuing unresolved need in the art for ever more interesting, improved and exciting board games and apparatus for use therewith.

SUMMARY OF THE INVENTION

Accordingly, it is a general object of the present invention to provide an improved and innovative gaming platform. It is a more particular object of the present invention to provide an improved gaming platform which enhances the variety and interest of game play through a changeable game play surface. It is a still more particular object of the present invention to provide an improved gaming platform which may be conveniently configured into a closed configuration for easy transport and storage and may, alternatively, be configured in an open game play configuration in which the game play surface is exposed and configured for play.

By way of overview, the present invention includes a game which utilizes a multi-surface play surface having a plurality of locations defined thereon. A plurality of topographical features are removably attachable to selected ones of the locations to further alter the game play surface. A surface base supports a plurality of light source nodes interconnected by pluralities of light transmitting elements. Light is directed upwardly through the light source nodes. Additionally, selected portions of the game play surface which overlay on top of a light source node define surface locations which include light transmissive elements constructed to avoid blocking the light therefrom. By way of further addition, selected surface features also include light transmissive elements to further avoid blocking light from the light source node and game play surface location. In accordance with an important aspect of the present invention, the surface base is formed in two segments and is supported upon a book-like housing which may be opened and closed to move the surface base segments and the surface portions thereon between a closed configuration further resembling a closed book and an open configuration exposing the game play surface. An important feature of the book-like housing includes a mechanism for raising and lowering one of the surface base segments within the housing to facilitate complete closure thereof.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIGS. 24A through 24E set forth sequential perspective views of an alternate embodiment of the present invention variable gaming surface platform changing configuration from its closed configuration to its open game play configuration;

DESCRIPTION OF THE PREFERRED EMBODIMENT

Figure 1:
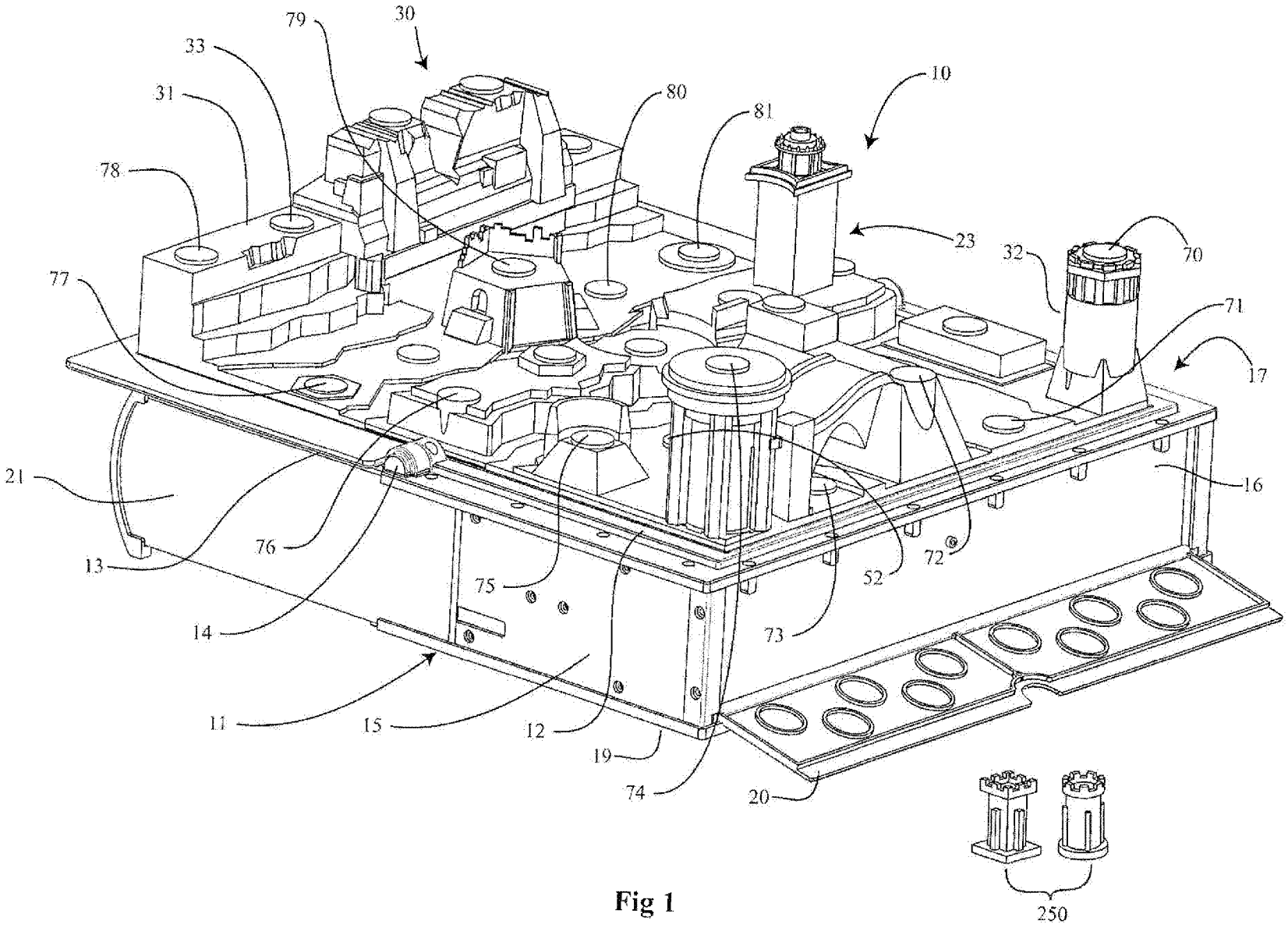
FIG. 1 sets forth a perspective view of a variable gaming surface platform constructed in the present invention configured in its open game play configuration.

FIG. 1 sets forth a perspective view of a variable gaming surface platform constructed in the present invention and generally referenced by numeral 10. Variable gaming surface platform 10 is shown in FIG. 1 configured in its open game play configuration. For purposes of illustration, and with temporary reference to FIG. 2, a perspective view of variable gaming surface platform 10 is shown configured in its closed configuration. In accordance with the apparatus set forth below in greater detail and in accordance with an important aspect of the present invention, variable gaming surface platform 10 may be reconfigured for convenient storage and transport into the closed configuration shown in FIG. 2 utilizing a novel support apparatus (also set forth below).

Returning to FIG. 1, variable gaming surface platform 10 is fully configured for game play. Thus, variable gaming surface platform 10 includes a generally rectangular housing 11 which, as is better seen below in FIG. 18C, defines a generally rectangular interior cavity. Accordingly, housing 11 defines a front panel 16 and a rear panel 18. The latter is shaped to resemble the binding of a book and thus is referred to hereinafter as binding 18. Housing 11 further includes a side panel 15 and a side panel 17 (side panel 17 not seen due to the perspective view of FIG. 1) but will be understood to be the mirror image of side panel 15. Housing 11 further includes a bottom 19 and a cover 13. Cover 13 is pivotally secured to binding 18 by a hinge 14. Thus, cover 13 is pivotally movable between the open configuration shown in FIG. 1 and the closed configuration shown in FIG. 2 as it pivots about hinge 14. Housing 11 also includes a side panel 21 which slides driven by gear 134 and rack 130 and is captured by housing 11 and bottom piece 19. Side panel 21 is movable sliding between the position shown in FIG. 1 in which it supports cover 13 and the closed position shown in FIG. 2. While not seen in the perspective view of FIG. 1, it will be understood that housing 11 also includes a second side panel 23 which is a mirror image of side panel 21 and which is also slidably secured and is captured by housing 11 and bottom piece 19, in the same manner as side panel 21.

Variable gaming surface platform 10 further includes a front panel 20 which is pivotally supported upon front 16 of housing 11. A platform 12 is supported upon housing 11 and, in accordance with the apparatus set forth below in greater detail, may be raised in the open configuration of variable gaming surface platform 10 or lowered within housing 11 in the closed configurations of variable gaming surface platform 10. Variable gaming surface platform 10 further includes a game play surface generally referenced by numeral 30 which is supported upon platform 12 and cover 13 in the manner described below. In accordance with an important aspect of the present invention, game play surface 30 supports a plurality of game marker locations 70 through 81 which identify positions at which various game pieces 250 may be positioned during game play. In further accordance with the present invention, and in the preferred fabrication of the present invention set forth in FIGS. 4, 5 and 6, game play surface 30 is supported upon a base generally referenced by numeral 90. Base 90 is formed of a base portion 91 supported upon platform 12 and a base portion 92 supported upon cover 13. Base portions 91 and 92 meet at a junction 93. Base 90 supports a plurality of light source nodes 40 through 64 in a matrix arrangement. Each of light source nodes 40 through 64 provides an upwardly directed light.

Returning to FIG. 1, in the preferred fabrication of the present invention surface locations 70 through 81 are each aligned with and overlie a selected one of light source nodes 40 through 64. Because game play surface 30 provides light transmissive elements at each of surface locations 70 through 81, each surface location is illuminated from beneath by its respective light source node. The importance of this light feature is operative within game play surface 30 and will be more apparent in the descriptions which follow. Suffice it to note here that, each of surface locations 70 through 81 may cooperate with a game play piece situated thereon in a light play fashion.

Figure 3:
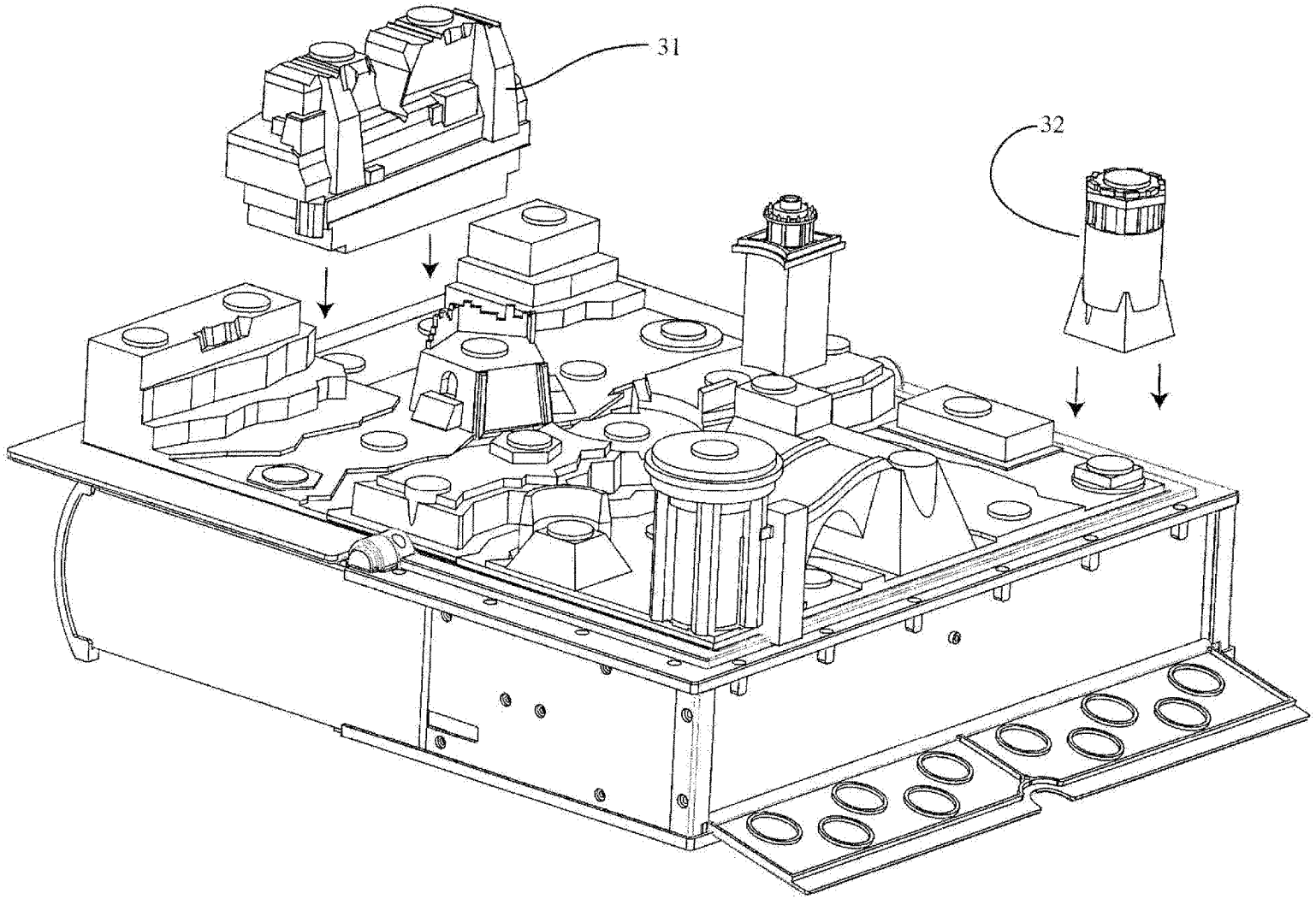
FIG. 3 sets forth a perspective assembly view of a variable gaming surface platform constructed in the present invention configured in its open game play configuration having several surface features prior to assembly.

Game play surface 30 further accommodates a plurality of removable surface features such as surface features 31 and 32 shown in FIG. 3 for illustration. As is better seen below in FIG. 3, surface features 31 and 32 each may be assembled to, or removed from, game play surface 30 at a selected surface location. In the preferred fabrication of the present invention, surface features such as surface features 31 and 32 accommodate further light play interactive elements which enhance the game play action of the surface feature. By way of further example, it will be noted that surface feature 31 further accommodates a surface location 33 which may, in turn, receive and support a game piece during game play in the same manner as surface locations 70 through 81 within game play surface 30. This further enhances the flexibility and complexity of game play.

Figure 2:
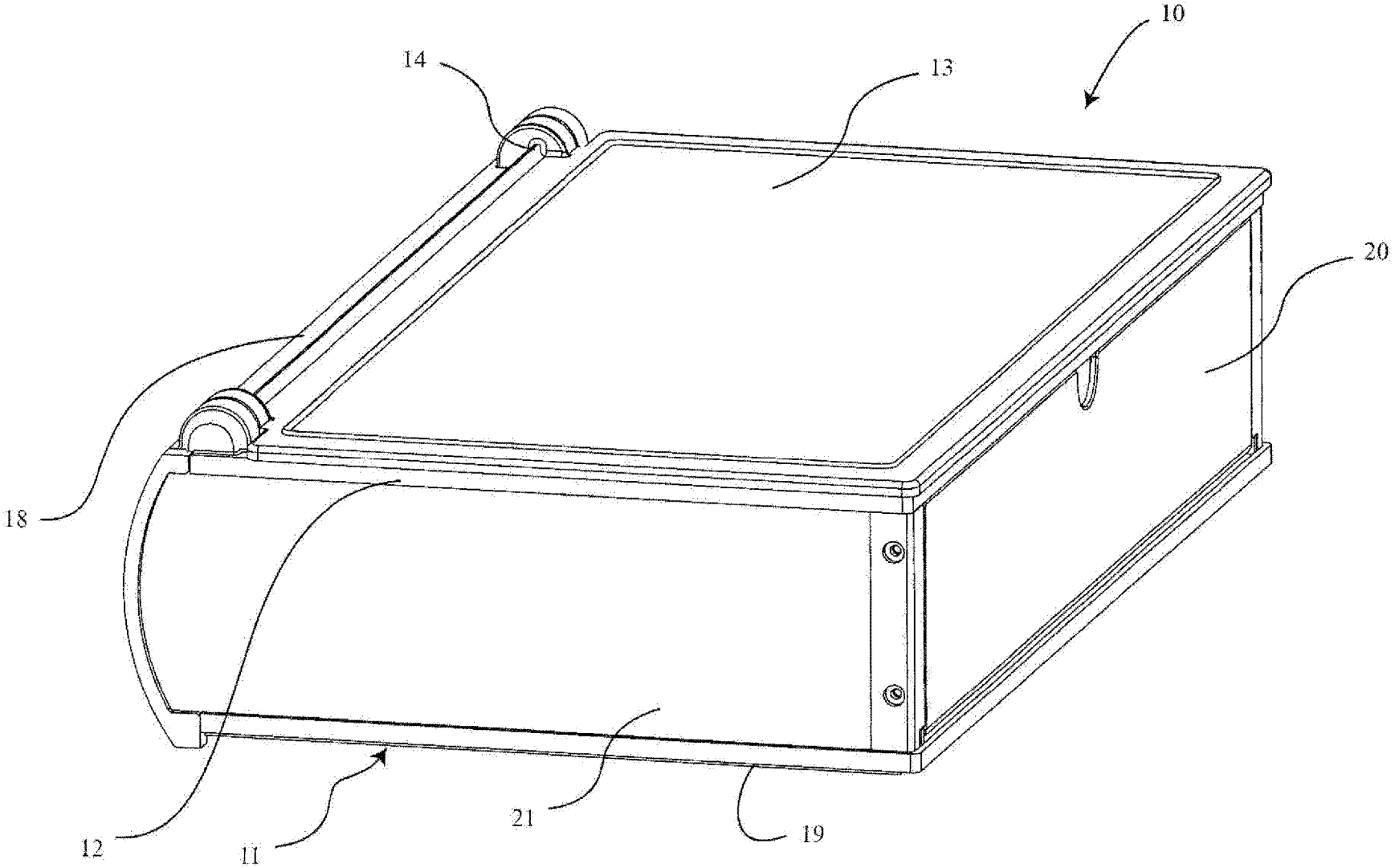
FIG. 2 sets forth a perspective view of a variable gaming surface platform constructed in the present invention configured in its closed configuration.

FIG. 2 sets forth a perspective view of game 10 in its closed configuration. As mentioned above, in the preferred fabrication of the present invention gaming surface 10 generally resembles a book when configured in the closed configuration. Accordingly, game 10 includes a housing 11 having a binding 18 a bottom 19 a side panel 21 and a front panel 20. As is also mentioned above, game 10 includes a side panel 23 not seen in the perspective view of FIG. 2 which is a mirror image of side panel 21. Housing 11 further includes a platform 12. In accordance with the closed configuration shown in FIG. 2, cover 13 which is coupled to binding 18 by a hinge 14 (seen in FIG. 1), is pivoted to overlie platform 12 completing the closure of game 10.

FIG. 3 sets forth a perspective view of game 10 in its open configuration illustrating the removal of surface features 31 and 32. It will be noted that the perspective view shown in FIG. 3 is substantially identical to the perspective view shown in FIG. 1. Accordingly, the descriptions set forth above in association with FIG. 1 will be understood to apply equally well to FIG. 3. The purpose of FIG. 3 is to provide an illustration of the removable character of surface features 31 and 32.

Figure 4:
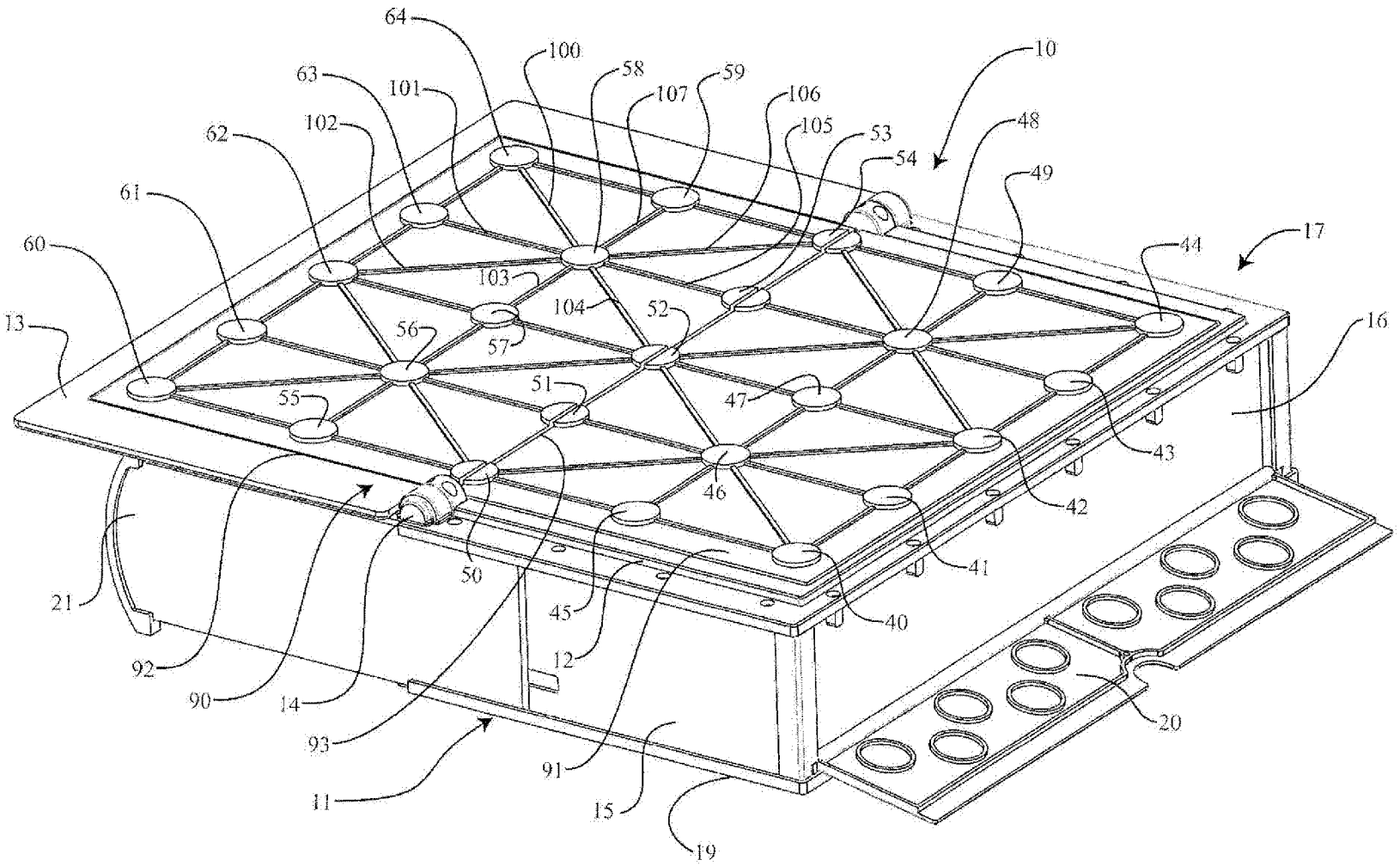
FIG. 4 sets forth a partial perspective view of a variable gaming surface platform constructed in the present invention configured in its open game play configuration showing the surface base.

FIG. 4 sets forth a perspective view of game 10 in an open configuration having game play surface 30 removed to reveal an underlying support base 90. Base 90 is comprised of a pair of generally planar base portions 91 and 92 secured to platform 12 and cover 13 respectively by conventional attachment means (not shown) such as adhesive attachment or the like. More specifically, and as is described above, game 10 includes a housing 11 configured to resemble a book having a bottom 19 a pair of sides 15 and 17 (side 17 not shown) together with a front 16 and a rear 18. Rear 18 is shaped to resemble a book binding and thus is referred to herein as binding 18. Housing 11 further includes a generally planar cover 13 pivotally supported upon housing 11 by a hinge 14 together with a platform 12 resting within sides 15 and 17 as well as front 16 and binding 18. In accordance with the apparatus set forth below in greater detail, platform 12 may alternatively be raised to the position shown in FIG. 4 or, alternatively, may be lowered into the interior of housing 11 in the manner set forth below in FIGS. 18A through 18D. Base portions 91 and 92 meet along a common junction 93 which facilitates the above-mentioned pivotal movement of cover 13 between the open configuration and closed configuration of game 10. In the open configuration shown, a side panel 21 is supported and captured by housing 11 and bottom piece 19 and slides rearward to the position shown to form a support beneath cover 13. While not seen in FIG. 4, it will be understood that a mirror image side panel 23 also is supported and captured by housing 11 and bottom piece 19 at the opposite side from side panel 21 and slides to a similar position beneath the opposing side of cover 13. In this manner cover 13 and platform 12 support base portions 91 and 92 facilitating their respective support of game play surface 30 (seen in FIG. 1).

In accordance with an important aspect of the present invention, base 90 supports a plurality of light source nodes 40 through 64 in a 5×5 row and column matrix. It will be apparent to those skilled in the art that the particular number and arrangement of light source nodes shown is provided for purposes of illustration and not limitation. Accordingly, it will be understood that a different number of light source nodes and a different arrangement of light coupling ribs connected between light source nodes may be provided without departing from the spirit and scope of the present invention. In further accordance with an important aspect of the present invention, each of light source nodes 40 through 64 is coupled to adjacent light source nodes by one or more light coupling ribs such as light coupling rib 100. The light coupling ribs set forth on base 90 provide light transmissive elements to transfer light energy between connected light source nodes. Thus, by way of example, light coupling ribs shown in FIG. 4 may comprise fiber-optic light elements or the like. In the example shown, light source node 58 is coupled to its adjacent light source nodes by a plurality of light coupling ribs 100 through 107. More specifically, light source node 58 is coupled to light source node 64 by light coupling rib 100. Similarly, light source node 58 is further coupled to light source nodes 62 and 63 by light coupling ribs 102 and 101 respectively. By further similarity, light source node 58 is further coupled to light source nodes 57 and 52 by light coupling ribs 103 and 104 respectively. By further continuation light source node 58 is coupled to light source nodes 53, 54 and 59 by light coupling ribs 105, 106 and 107 respectively. In this manner, by similar interconnection of light coupling ribs each of light source nodes 40 through 64 is coupled to one or more adjacent light source nodes.

Figure 5:
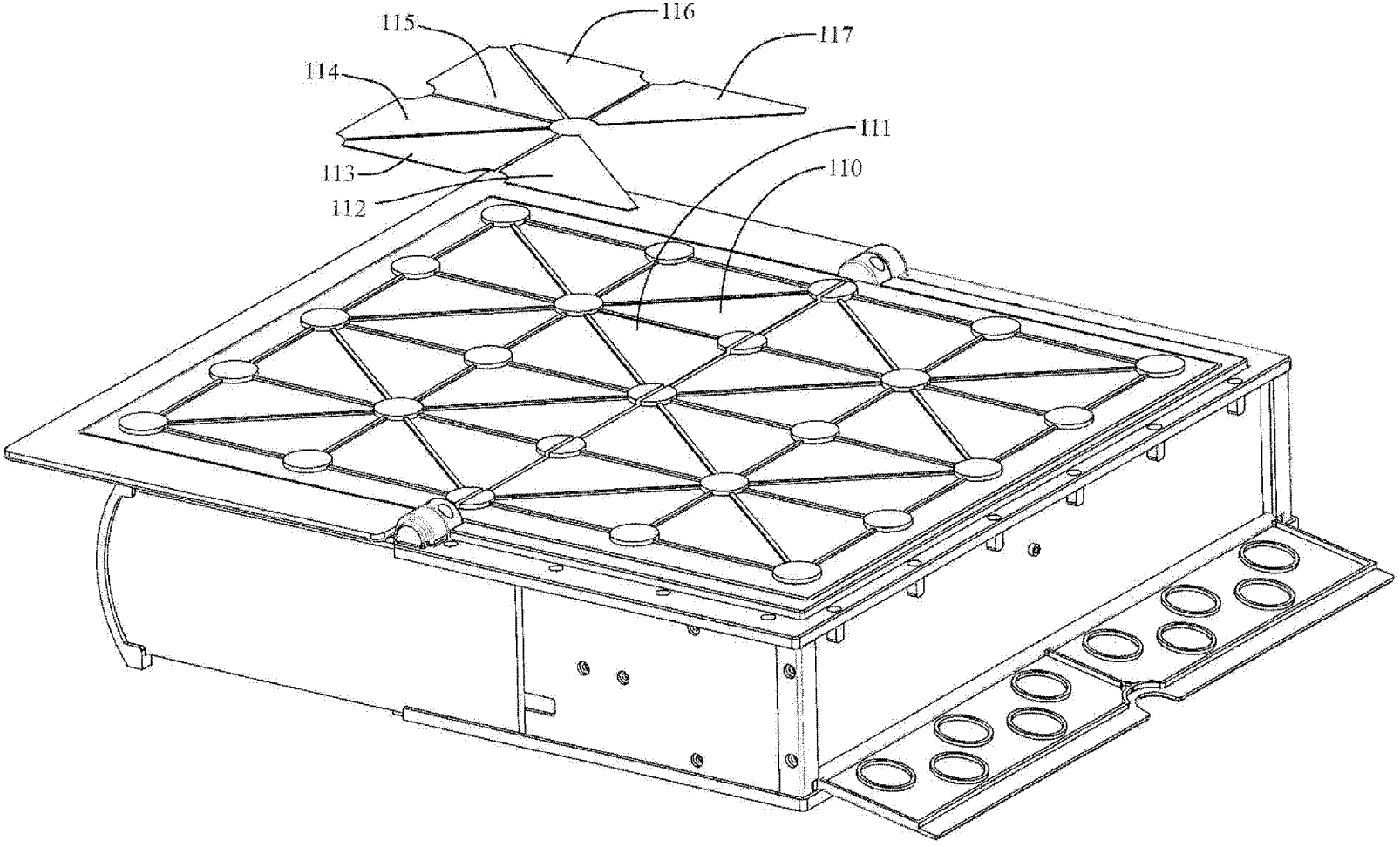
FIG. 5 sets forth a partial perspective assembly view of a variable gaming surface platform constructed in the present invention configured in its open game play configuration showing an opaque template for the surface base.
Figure 6:
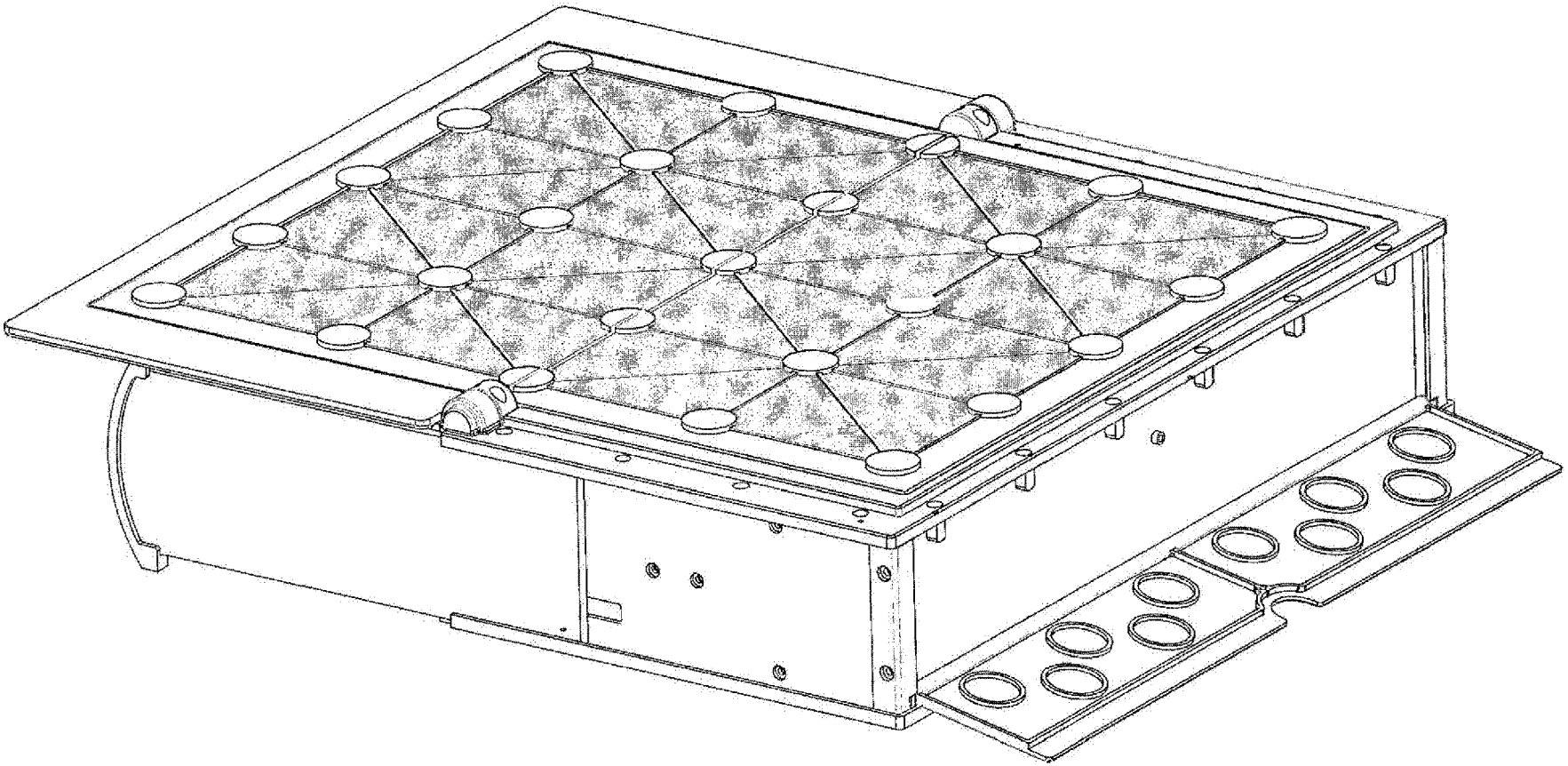
FIG. 6 sets forth a partial perspective view of a variable gaming surface platform constructed in the present invention configured in its open game play configuration showing the opaque template for the surface base.

FIGS. 5 and 6 set forth perspective views of the further processing of base 90 which provides opaque segments upon the surface of base 90 surrounding each of light source nodes 40 through 64 and the plurality of light coupling ribs interconnected there between. The use of opaque segments ensures that the light produced by the conventional light source within housing 11 (not shown) is concentrated within and transmitted exclusively through the light source nodes and light coupling ribs. This enhances the light play effects available to the game play by maintaining a maximum light intensity within the light source nodes and light coupling ribs.

More specifically, FIG. 5 sets forth an illustrative group of opaque segments 110 through 117 which are utilized in the surface areas surrounding light source node 58. For purposes of illustration the opaque segments are shown as planar elements. However, it will be apparent to those skilled in the art that in most applications, the opaque segments may comprise applied coatings of opaque material such as paint or the like. Alternatively, the opaque segments may be formed of opaque sheet material which are cut to fit the target areas and which is secured therein by means such as conventional adhesive or the like. In either event the intended function is to maintain opaque areas surrounding the light source nodes and light coupling ribs in FIG. 5, the opaque segments surrounding light source node 58 are referenced by numerals 110 through 117 and are shown being applied to the appropriate portions of surrounding surface of base 90. This process is carried forward for the remainder of surface portions within base 90 to produce the completely opaque areas shown in FIG. 6.

FIG. 6 sets forth a perspective view of game 10 showing the above-mentioned opaque segments applied to the entire surface of base 90. It will be apparent to those skilled in the art that once the opaque segments are in place light produced within the interior of housing 11 will be limited in its upward transmission through base 92 pass solely to that which passes through the light source nodes and light coupling ribs.

Figure 7:
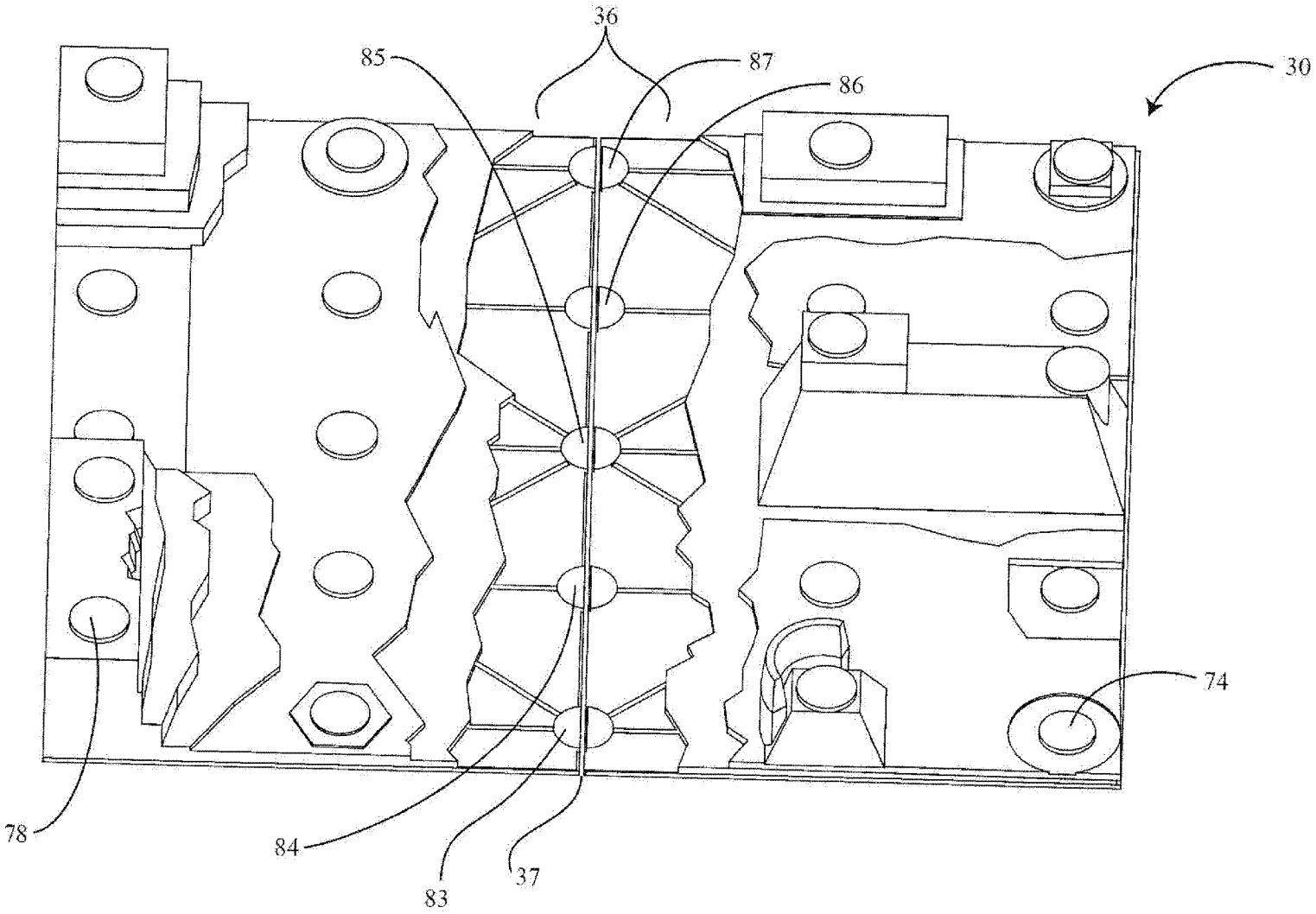
FIG. 7 sets forth a perspective view of the left and right-side surface portions utilized in a variable gaming surface platform constructed in the present invention.

FIG. 7 sets forth a perspective view of surface portions 34 and 35 which combined with center surface portion 38 (seen in FIG. 8) forms a complete game play surface 30. Game play surface 30 is fabricated of a pair of surface portions 34 and 35 which meet at a surface junction 37 game play surface 30 is formed in two surface portions to facilitate separate attachment to cover 13 and plane 12 (seen in FIG. 1) respectively. As described above, game play surface 30 forms a plurality of surface variations and surface contours together with a plurality of surface locations including surface location 78 formed on surface portion 34 and surface location 74 formed on surface portion 35. In addition, surface portions 34 and 35 define a surface junction area 36 which is substantially free of projecting surface contours to facilitate the above described like closure taking place when the present invention game is moved to its closed configuration. Surface junction area 36 defines a plurality of junction area surface locations 83 through 87 which are split by surface junction 37. This facilitates alignment with light source nodes 50 through 54 respectively (seen in FIG. 4).

Figure 8:
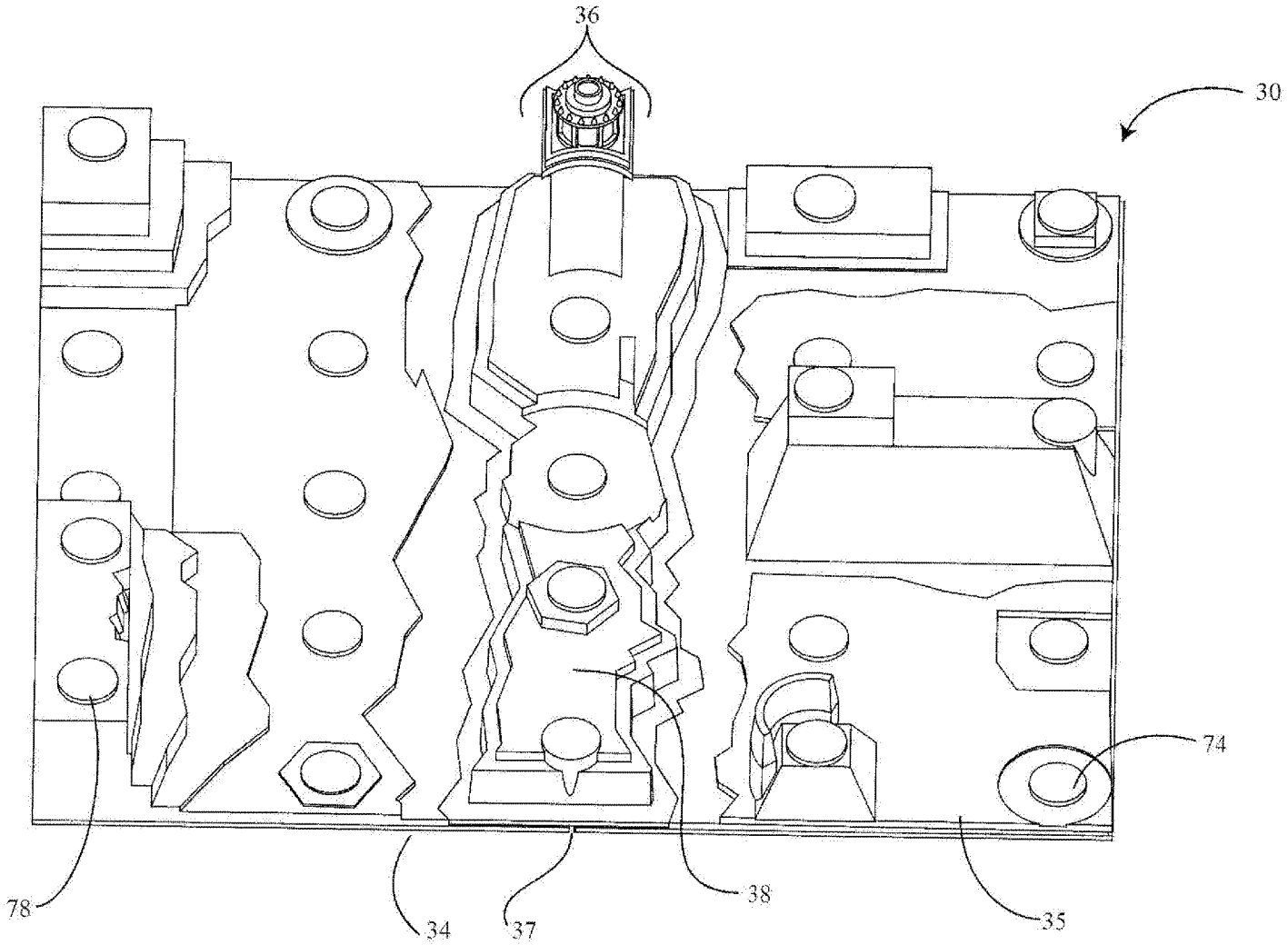
FIG. 8 sets forth a perspective view of the left and right-side surface portions utilized in a variable gaming surface platform constructed in the present invention having the center surface portion installed.

FIG. 8 sets forth the perspective view of game play surface 30 shown in FIG. 7 with the further addition of center surface portion 38. As mentioned above, and with concurrent reference to FIGS. 7 and 8, surface junction area 36 is relatively free of projecting surface contours to facilitate the opening and closing of book-like housing 11 utilized and illustrated in FIGS. 1 and 2. The avoidance of projecting features in surface junction area 36 prevents surface projections from interfering with each other during the closure. Once the game has been opened to its open configuration, game play surface 30 is completed by installing center surface portion 38 to interlock within and fit within surface junction area 36. It will be noted that in the preferred fabrication of the present invention, center surface portion 38 defines surface locations which are aligned with junction area surface locations 83 through 87 in order to maintain the continuity of light transmission through game play surface 30. It will be apparent to those skilled in the art that the process of returning game 10 from its open configuration shown in FIG. 1 to its closed configuration shown in FIG. 2 includes an early step of removing center surface portion 38.

Figure 9:
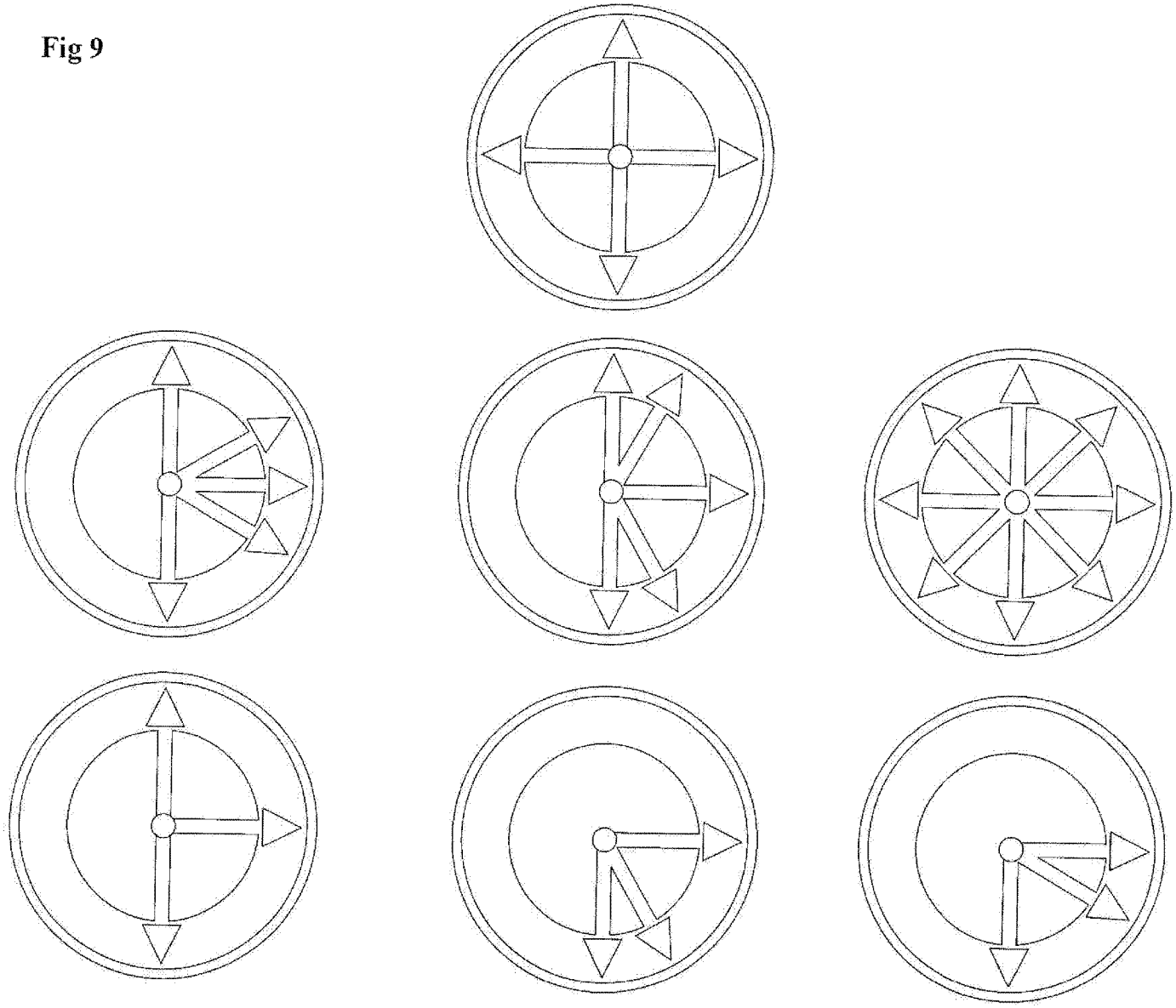
FIG. 9 sets forth game marker locations utilized in a variable gaming surface platform constructed in the present invention.

FIG. 9 sets forth illustrative diagrams of the various directional combinations available for the game marker locations utilized for example as surface locations 70 through 81 in FIG. 1. Of importance to note is the flexibility which the various directional combinations of the surface locations provide in setting up the game play. For example, the game play rules may provide that a play piece may only be moved from a given surface location in accordance with one of the direction indicators formed on the surface location.

Figures 10, 11:
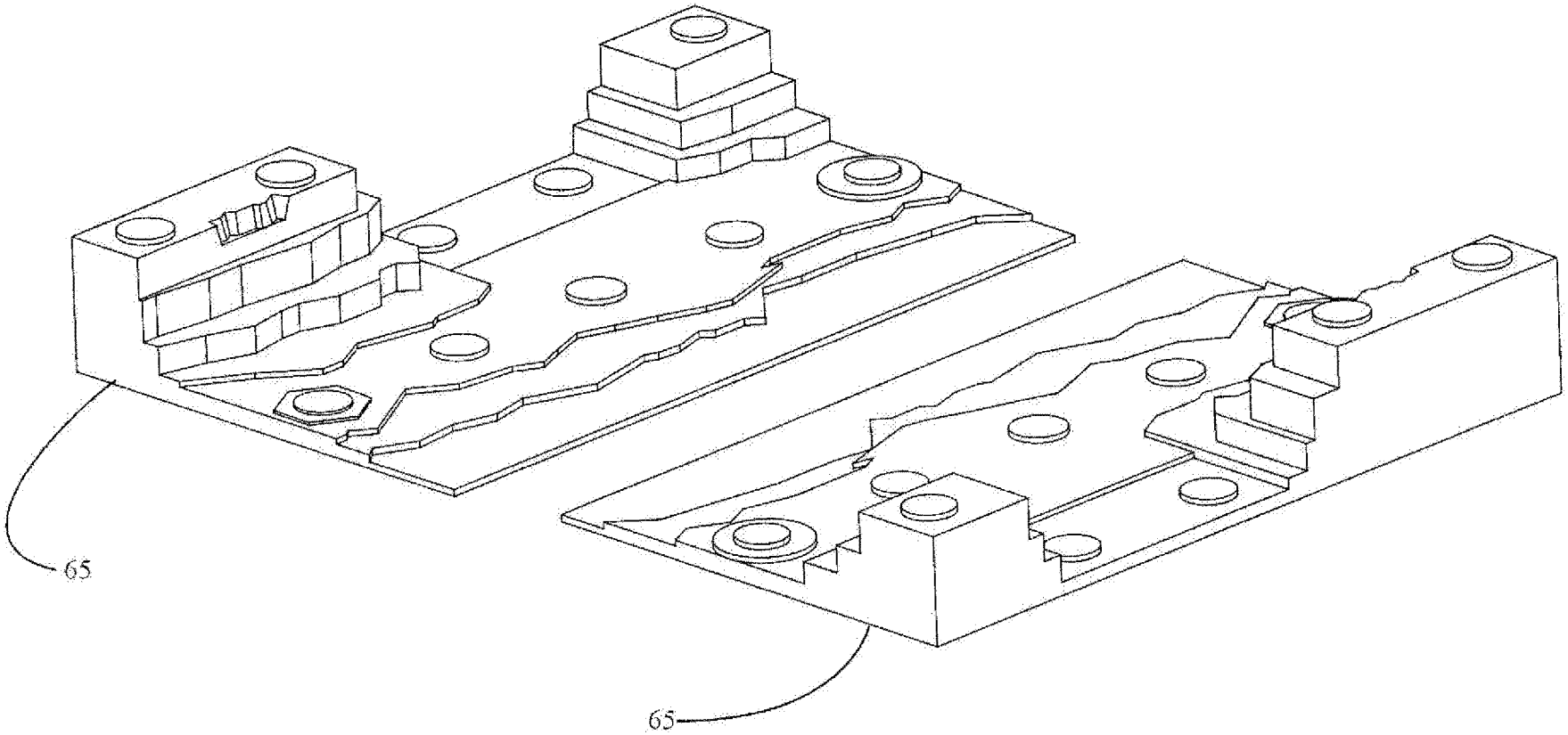
FIG. 10 sets forth a front perspective view of a surface feature utilized in a variable gaming surface platform constructed in the present invention.
FIG. 11 sets forth a rear perspective view of the surface feature shown in FIG. 10.
Figure 12:
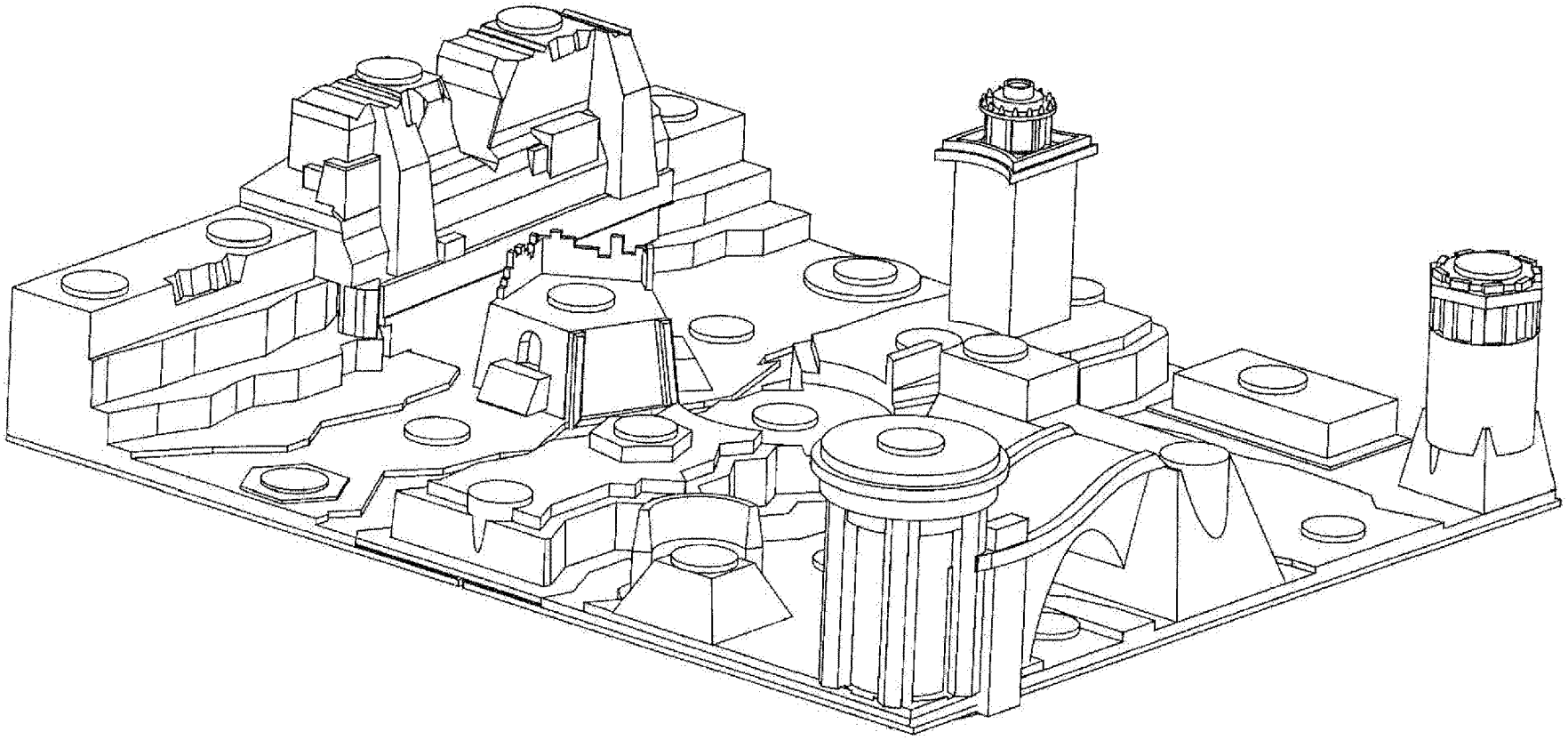
FIG. 12 sets forth a perspective view of a further example of a variable surface utilized in a variable gaming surface platform constructed in the present invention.

FIGS. 10 and 11 show respective front and rear perspective views of illustrative surface features which may be utilized in instructing game play surface 30 in the above described configuration of the game into its full game play mode. It will be apparent to those skilled in the art that FIGS. 10 and 11 show front and rear perspective views of illustrative surface feature 65 solely for illustration and not by way of limitation. A virtually endless variety of surface features may be applied to form game play surface in accordance with the present invention FIG. 12 sets forth a perspective view of an illustrative game play surface fabricated which utilizes surface feature 65 to form one end of the game play surface. It will be noted that other surface features have been added to the game play surface shown to provide a significantly different game play surface which varies substantially from game play surface 30 shown in FIG. 1.

FIGS. 13, 14, 15, 16 and 17 set forth sequential perspective views of an alternate embodiment of the present invention game generally referenced by numeral 120. Game 120 is substantially similar to game 10 described above in that it utilizes a book-like housing 11 to support a platform 12 and a cover 13 which facilitates opening housing 11 to an open configuration such as that shown in FIG. 13 and alternatively closing housing 11 to the closed configuration such as that shown in FIG. 2. By way of further similarity game 120 supports a base 90 fabricated in the manner set forth above in FIG. 4 which is formed of a base portion 91 supported by platform 12 and base portion 92 supported by cover 13.

Figure 13:
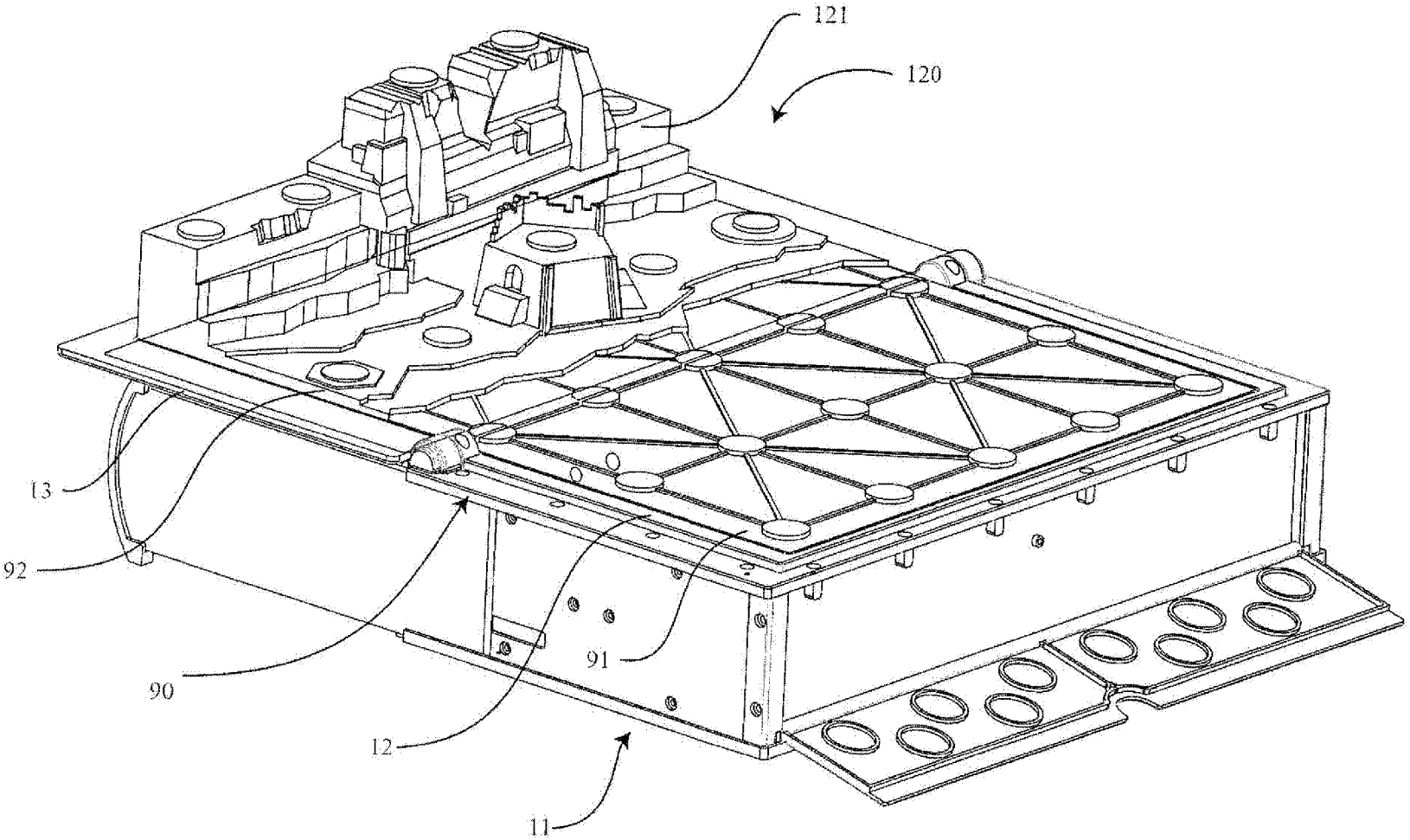
FIG. 13 sets forth a perspective view of a variable gaming surface platform constructed in the present invention configured in its open game play configuration showing the surface base and a surface feature installed thereon.
Figure 14:
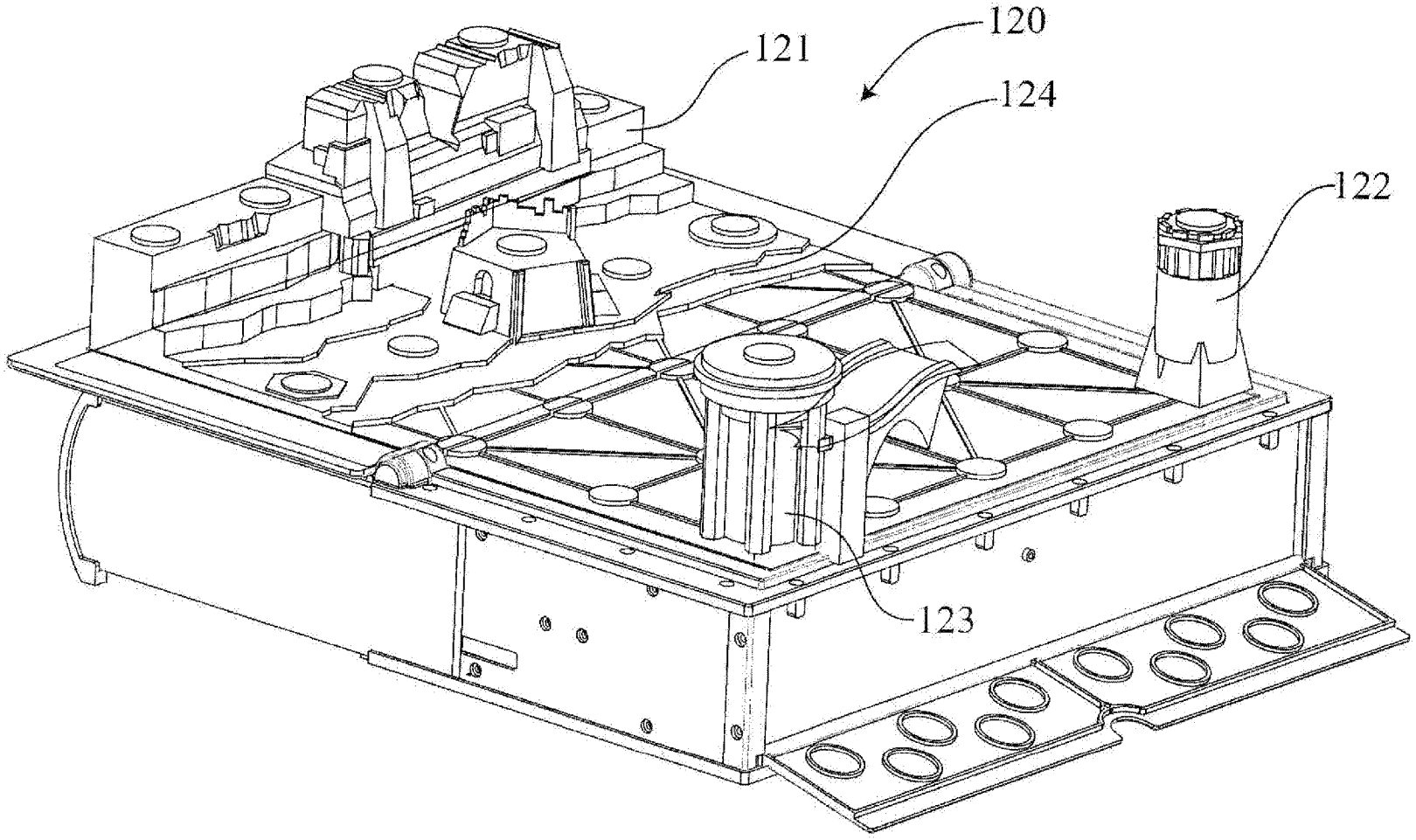
FIG. 14 sets forth a perspective view of a variable gaming surface platform constructed in the present invention configured in its open game play configuration showing the surface base and a plurality of surface features installed thereon.
Figure 15:
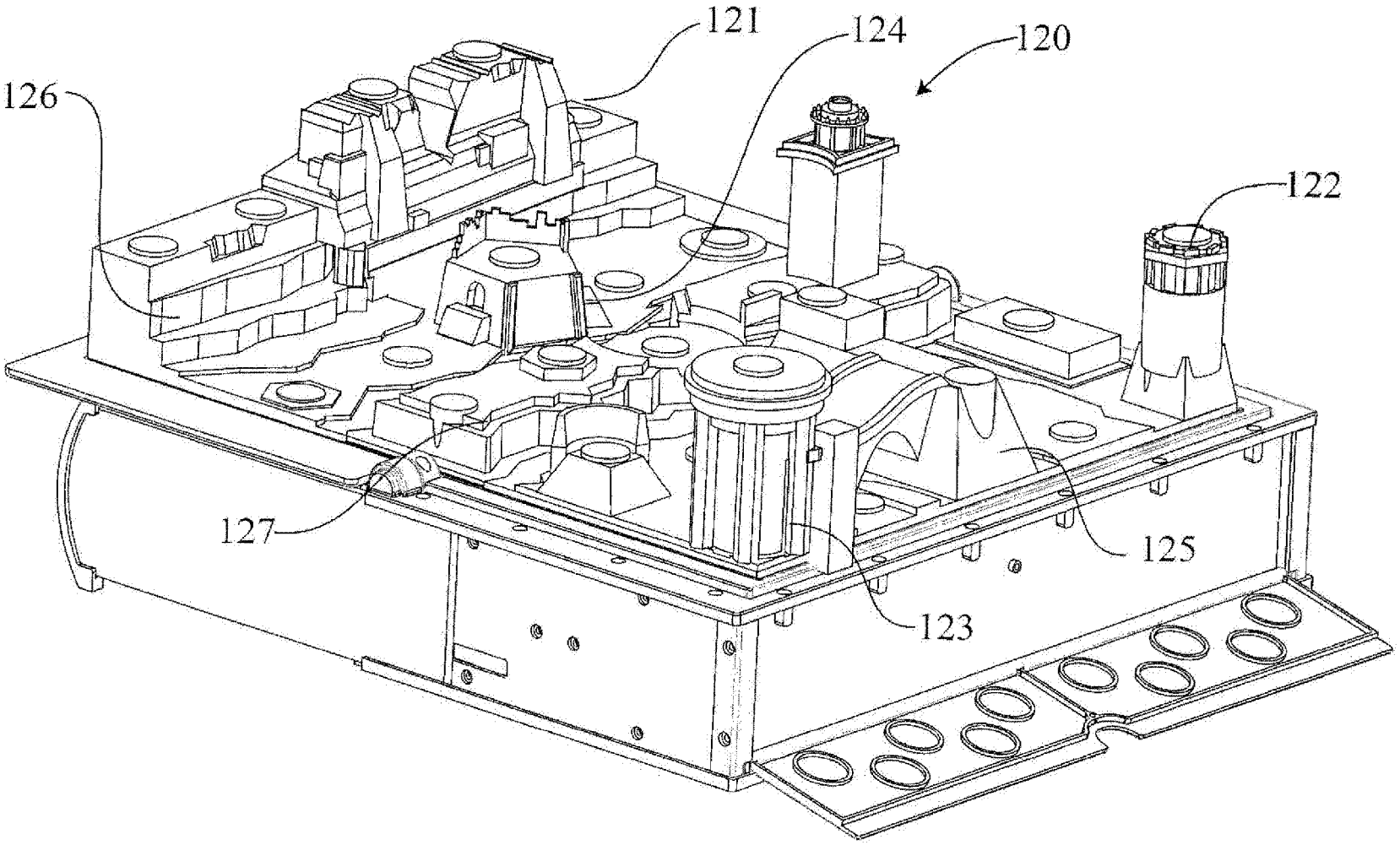
FIG. 15 sets forth a perspective view of a variable gaming surface platform constructed in the present invention configured in its open game play configuration showing the surface base and a plurality of surface features installed thereon.
Figure 16:
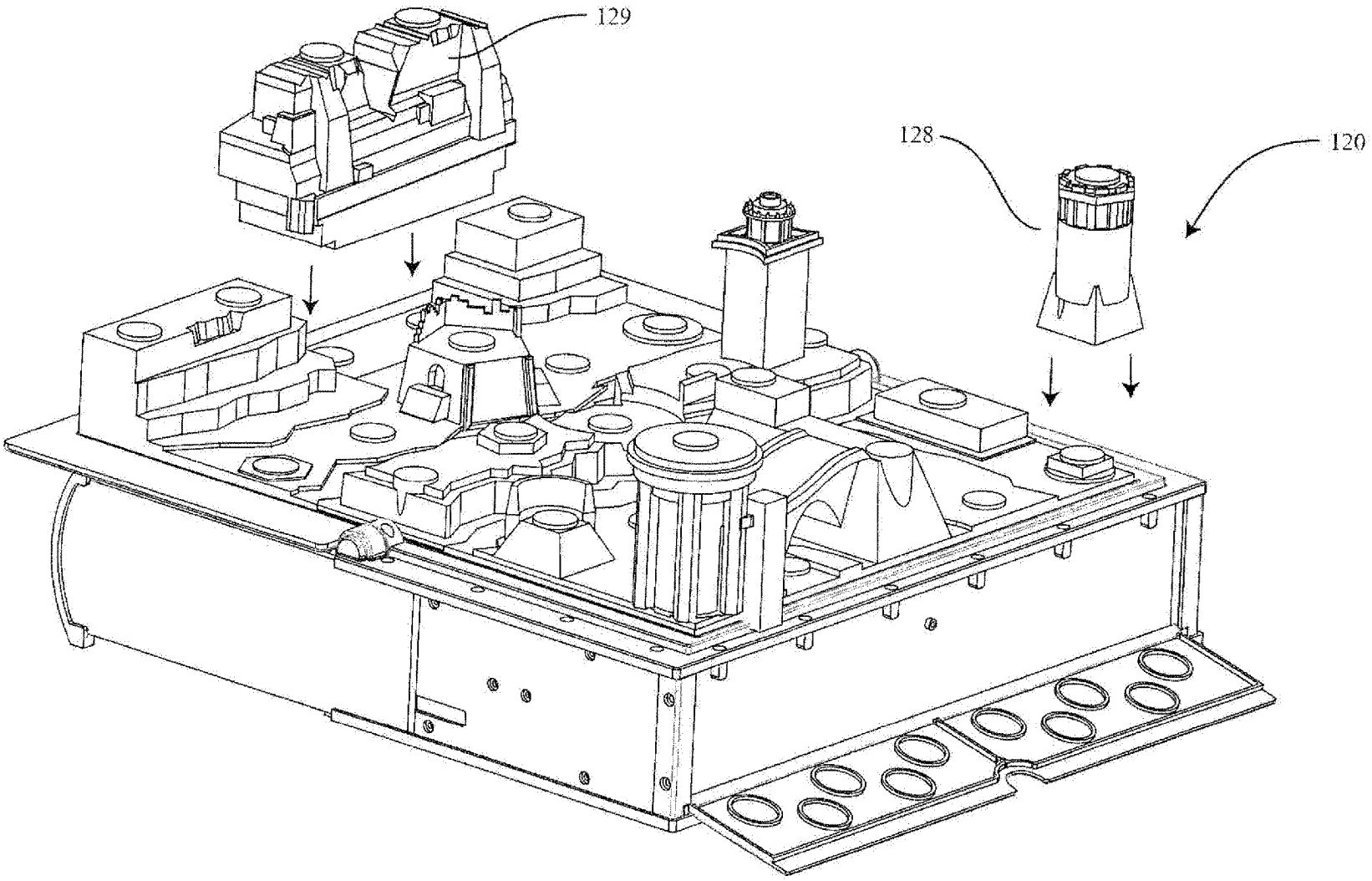
FIG. 16 sets forth a perspective assembly view of a variable gaming surface platform constructed in the present invention configured in its open game play configuration showing the surface base and a plurality of surface features installed thereon together with additional surface features being assembled.
Figure 17:
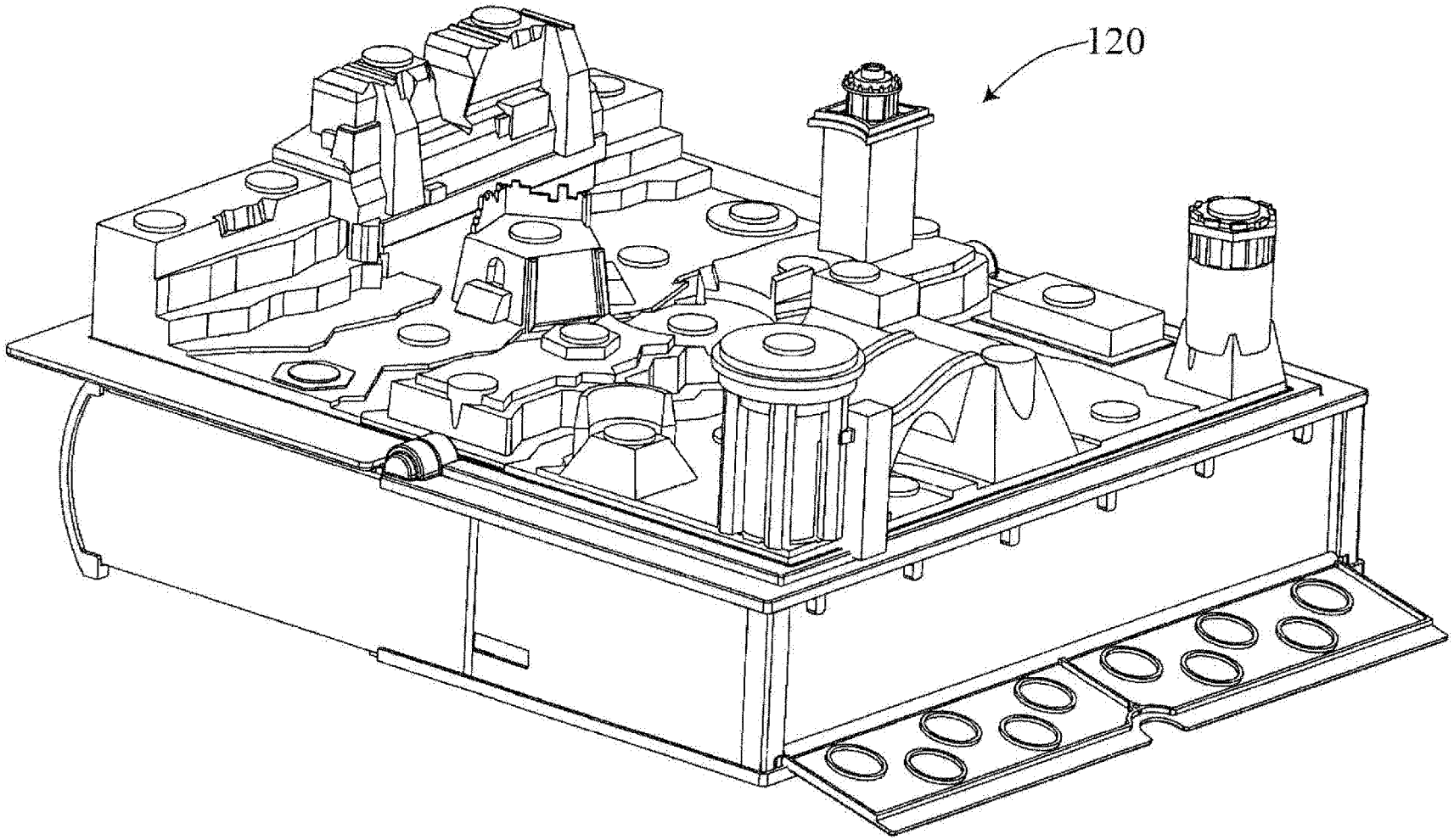
FIG. 17 sets forth a perspective view of a variable gaming surface platform constructed in the present invention configured in its open game play configuration showing the surface base and a plurality of surface features installed thereon.

Game 120 differs from game 10 set forth and described above the game play surface is fabricated utilizing a plurality of individual surface features which are each directly secured to a portion of base 90 rather than being supported upon a game play surface such as game play surface 30 set forth above in FIGS. 7 and 8. Accordingly, FIG. 13 shows a surface feature 121 positioned upon a portion of base 90 to begin the surface assembly process. Correspondingly, FIGS. 14, 15, 16 and 17 show successive feature attachments which complete the alternative embodiment game play fabrication. For example, FIG. 14 shows the installation of surface features 122, 123 and 124. Similarly, FIG. 15 shows the further installation of surface features 125, 126 and 127. FIG. 16 shows the further installation of surface features 128 and 129. Finally, FIG. 17 shows the fully assembled construction of game 120. It will be apparent to those skilled in the art that game 120 is returned to its closed configuration by a reverse process in which surface features 121 through 129 are removed from base 90 allowing housing 11 to again be moved to its closed configuration.

By way of overview the figures and descriptions which follow show alternate embodiments for carrying forward the functions of the present invention game involved in configuring the game either in a closed, book-like, configuration or, alternatively, in an open game play configuration. Thus, FIGS. 18A through 18D set forth sequential perspective figures showing a first embodiment transforming from its closed configuration (FIG. 18A) to its open configuration (FIG. 18D). FIGS. 19 through 23 set forth perspective views of the operative mechanism which facilitates the configuration of this first embodiment. In a similar fashion, FIGS. 24A through 24E set forth sequential perspective figures showing a second embodiment transforming from its closed configuration (FIG. 24A) to its open configuration (FIG. 24E). FIGS. 25 through 30 set forth perspective views of the operative mechanism which facilitates the configuration of this second embodiment.

Figure 18A:
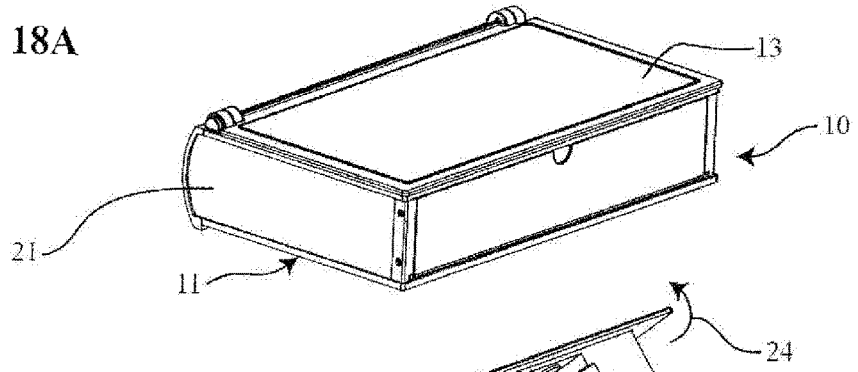
FIGS. 18A through 18D set forth sequential perspective views of a variable gaming surface platform constructed in the present invention changing configuration from its closed configuration to its open game play configuration.

More specifically, FIG. 18A sets forth a perspective view of game 10 in its closed configuration. As described above, game 10 attains this closed configuration by pivoting cover 13 of housing 11 to the position shown. It will also be recalled that the closed configuration of game 10 is further characterized by the position of side panel 21 upon side 15 of housing 11.

Figure 18B:
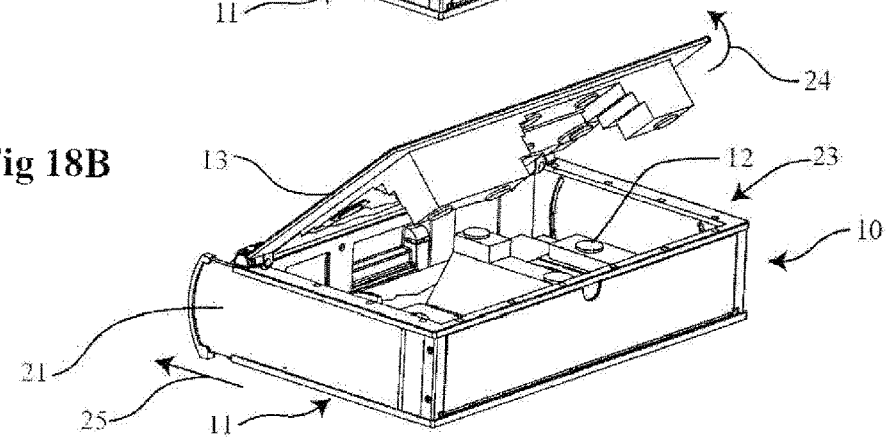
Figure 18C:
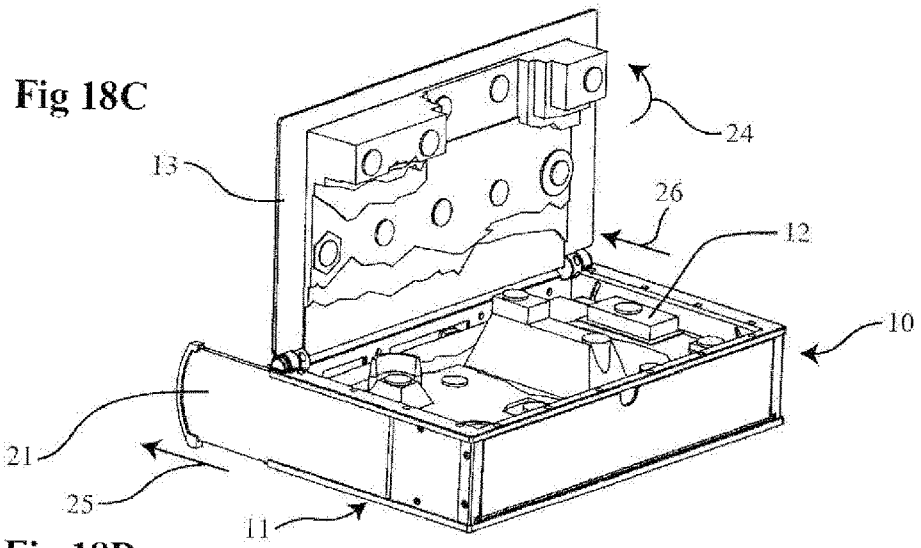
Figure 18D:
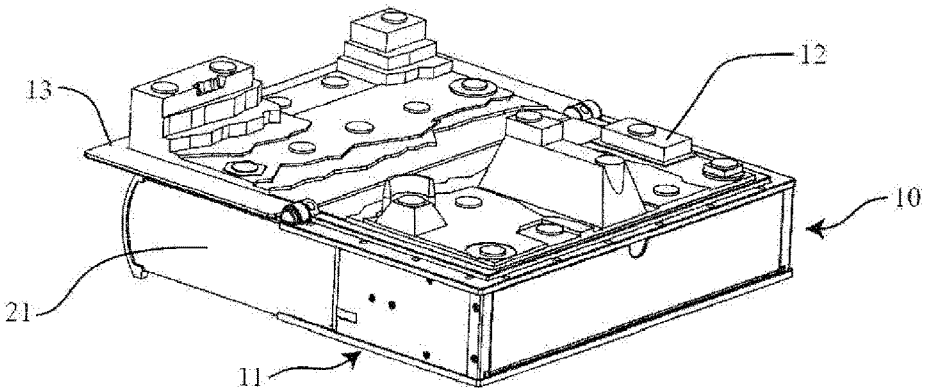

FIG. 18B sets forth a perspective view of game 10 at the initial step in transforming the game from the closed configuration of FIG. 18A to the open configuration of FIG. 18D. This initial step is carried forward by pivoting cover 13 upwardly in the direction indicated by arrow 24. In accordance with the operative mechanisms set forth below in greater detail, the upward pivotal motion of cover 13 also imparts a rearward sliding motion to side panels 21 and 23 in the respective directions indicated by arrows 25 and 26, respectively. FIG. 18B also allows the observation of the manner in which several game play surface features have "nested" within housing 11 when cover 13 is moved to its closed position.

FIG. 18C sets forth an intermediate point in the transformation of game 10 in which cover 13 continues to be pivoted in the direction indicated by arrow 24. As a result of this continued pivoting of cover 13, side panels 21 and 23 (not seen) continue being moved rearwardly in the direction indicated by arrows 25 and 26 (also not seen). It will also be noted that as cover 13 continues to be pivoted toward its fully open position, the operative mechanism described below raises platform 12 and the portion of game play surface supported thereon upwardly within housing 11.

FIG. 18D sets forth a perspective view of game 10 in its open configuration suitable for game play. Of importance to note is the movement in the direction indicated by arrow 24 to the horizontal position shown of cover 13 has resulted in raising platform 12 within housing 11 and has resulted in positioning side panels 21 and 23 (not shown) beneath cover 13. The positioning of side panels 21 and 23 (not shown) beneath cover 13 in the open configuration of game 10 provides support for cover 13 during game play. It will be apparent to those skilled in the art that game 10 may be returned to the closed configuration shown in FIG. 18A by essentially reversing the previously described sequential operations.

Figure 19:
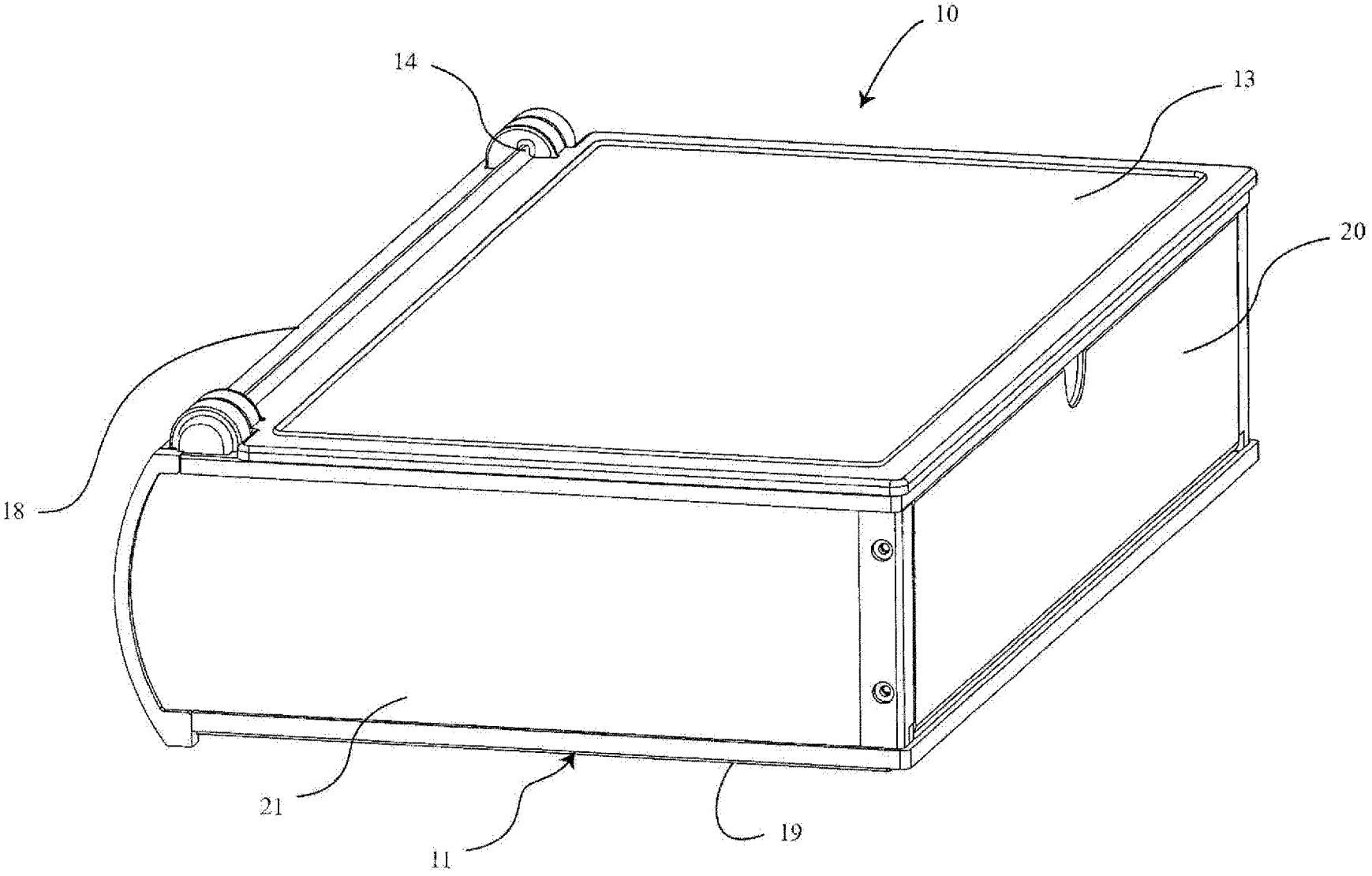
FIG. 19 sets forth a perspective view of the embodiment of the variable gaming surface platform shown in FIG. 18A configured in its closed configuration.

FIG. 19 sets forth a perspective view of game 10 in its closed configuration. For purposes of illustration in describing and illustrating the operative mechanism which are set forth below, the closed configuration shown in FIG. 19 will be utilized as the initial starting point for the mechanisms. Thus, game 10 includes a housing 11, described above, having a bottom 19 a side panel 21 a front panel 20 a binding 18 and a cover 13. Cover 13 is pivotally joined to binding 18 by a hinge 14. In the closed configuration shown in FIG. 19, cover 13 has been pivoted about hinge 14 to overlie the upper edge of housing 11. Additionally, side panel 21 is positioned against housing 11 as is front panel 20. While not seen in FIG. 19 due to the perspective view thereof, it will be understood that a second side panel 23 (not shown) is positioned on the opposite side of housing 11 in the same manner as side panel 21.

Figure 20:
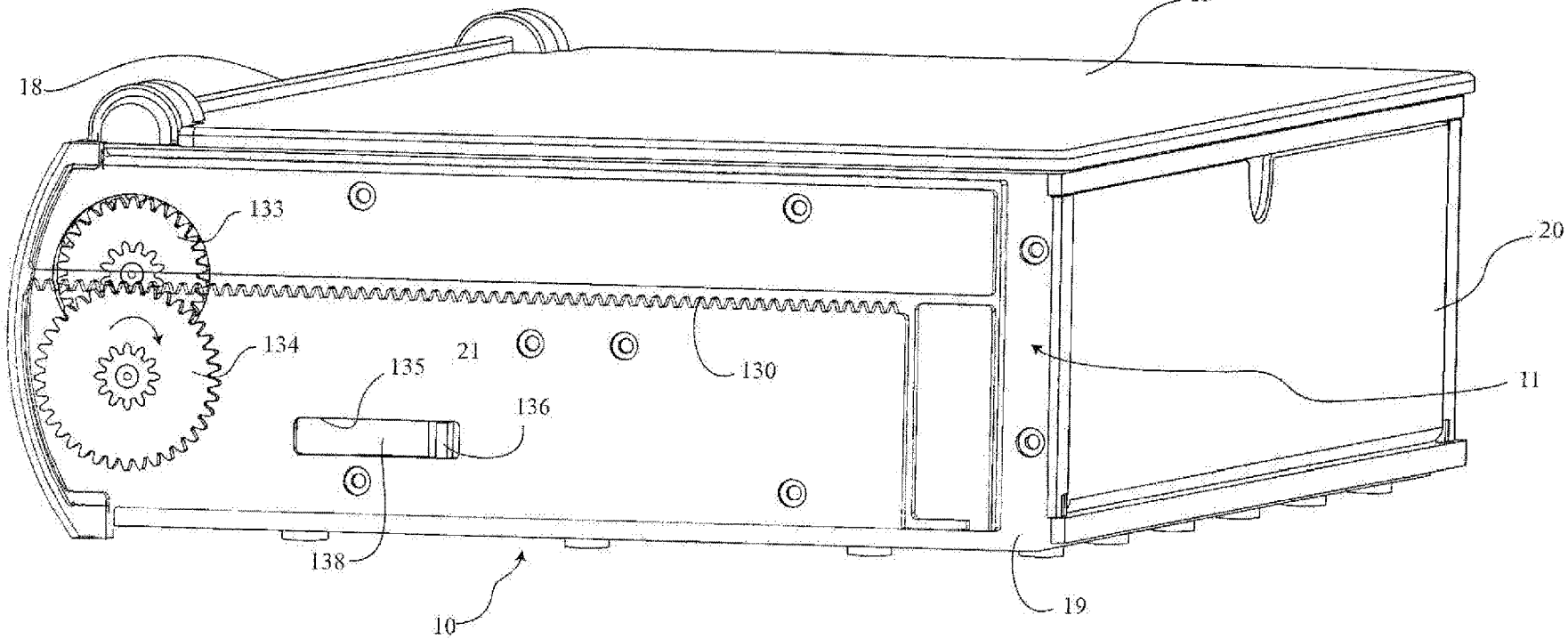
FIG. 20 sets forth a partial perspective view of the embodiment of the variable gaming surface platform shown in FIG. 18A configured in its closed configuration.
Figure 21:
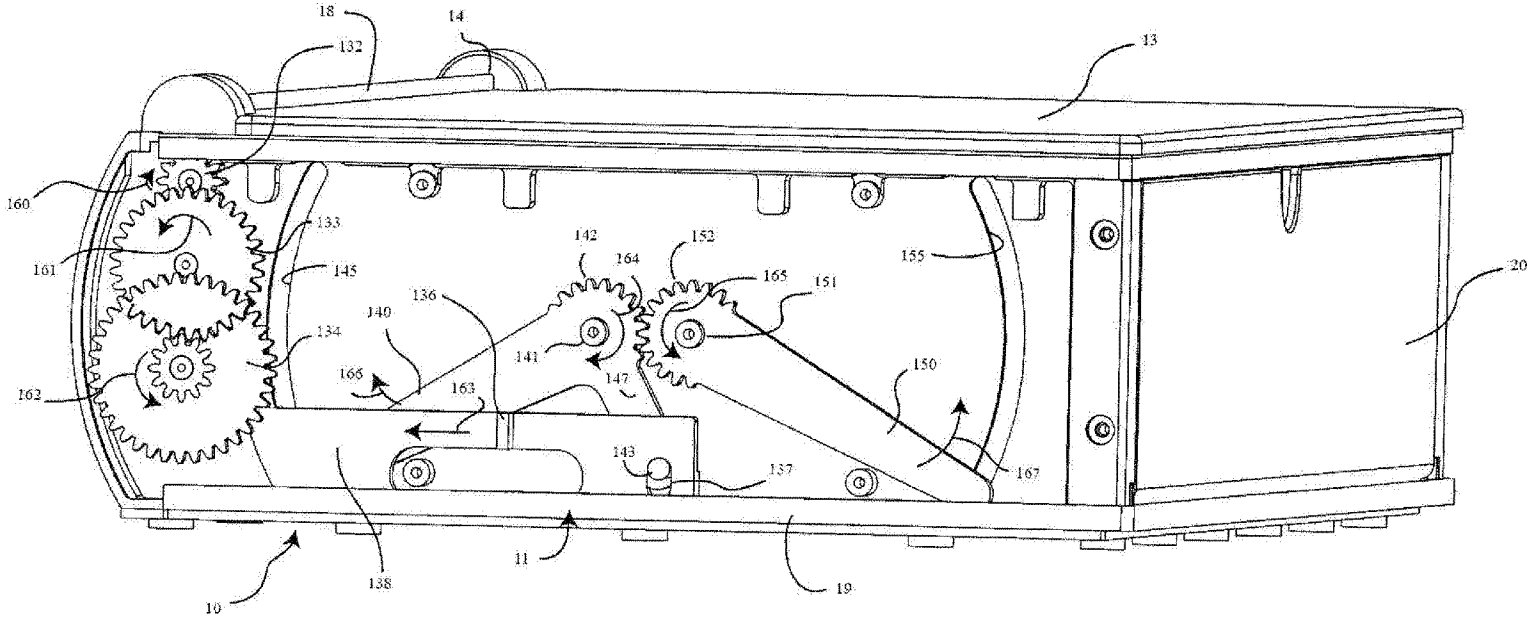
FIG. 21 sets forth a partial perspective view of the embodiment of the variable gaming surface platform shown in FIG. 18A configured in its closed configuration.
Figure 22:
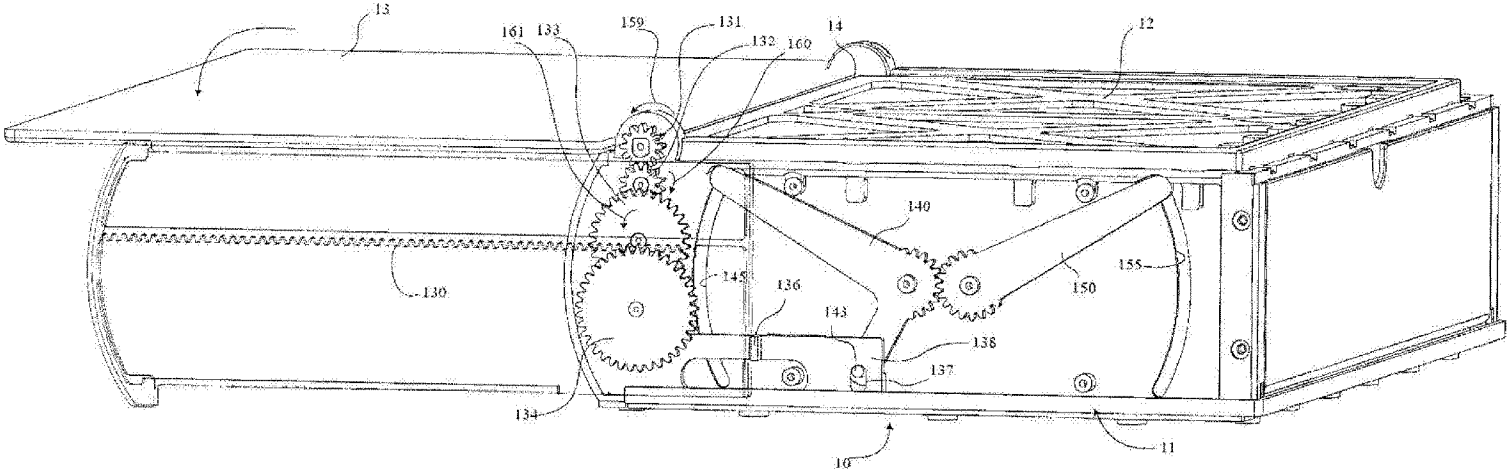
FIG. 22 sets forth a partial perspective view of the embodiment of the variable gaming surface platform shown in FIG. 18D configured in its open game play configuration.

FIG. 20 sets forth a partial perspective view of the operative mechanism of game 10 in the initial closed configuration. It will be understood that the operative mechanism set forth in FIGS. 20, 21 and 22 is repeated as a mirror image of the mechanism on the opposite side of housing 11 which is not seen because of the perspective view of housing 11. This operational mechanism will be understood to be virtually identical to the mechanism shown in the following figures. Accordingly, the descriptions and illustrations set forth in FIGS. 20, 21 and 22 will be understood to apply equally well to the mirror image operative mechanism positioned on the opposite side of housing 11. As described above, game 10 includes a housing 11 which resembles a book and includes a bottom 19, a cover 13, a front panel 20, a binding 18 and a side panel 21. For purposes of illustration, side panel 21 is shown in transparency to facilitate the illustration of an elongated gear rack 130 which extends the entire length of the interior surface of side panel 21. Side panel 21 also defines an elongated slot 135. Housing 11 further supports a gear 133 which is coupled to a gear 134. Gear 134 engages gear rack 130. A slide 138 is supported behind side panel 21 and supports a post 136 which extends through slot 135 and couples slide 138 to side panel 21.

FIG. 21 sets forth a perspective view of game 10 having side panel 21 removed. As described above, game 10 includes a housing 11 having a front panel 20, a side panel 21 (not shown) and a binding 18. As is also described above, housing 11 includes a cover 13 pivotally secured to housing 11 by a hinge 14. A gear 132 engages a gear 131 (seen in FIG. 22) which is joined to cover 13 and is rotatable therewith. Gear 132 engages gear 133 which, in turn, engages gear 134. As is better seen in FIG. 20, gear 134 engages gear rack 130 of side panel 21. Returning to FIG. 22, a slide 138 supports a post 136 which, as is better seen in FIG. 20, is received within slot 135 of side panel 21. Slide 138 further defines a slot 137. A pair of arms 140 and 150 are pivotally supported upon housing 11 by a pair of pivot pins 141 and 151 respectively. Arm 140 defines a gear segment 142 and an extending arm 147. Arm 150 defines a gear segment 152 engaging gear segment 142. Housing 11 defines a pair of curved slots 145 and 155. The end portions of arms 140 and 150 extend through slots 145 and 155 respectively to engage platform 12 (seen in FIG. 22). Arm 147 of arm 140 supports a post 143 which extends into slot 137 of slide 138.

In operation, as cover 13 is opened it pivots about hinge 14 causing counterclockwise rotation of gear 131 in the direction indicated by arrow 159 in FIG. 22. The rotation of gear 131 in the direction indicated by arrow 159 causes gear 132 to be rotated in the direction indicated by arrow 160. Gear 133 is engaged with gear 132 and thus is rotated in the direction indicated by arrow 161. The rotation of gear 133 is coupled to gear 134 by an intermediate gear coupling that causes gear 134 to be rotated in the direction indicated by arrow 162. With temporary reference to FIG. 20, it will be noted that rotation of gear 134 in the direction indicated by arrow 162 moves side panel 21 and slide 138 in the direction indicated by arrow 163. Returning to FIG. 21, the movement of slide 138 in the direction indicated by arrow 163 is coupled by slot 137, post 143 and arm 147 to arm 140 causing arm 140 to be pivoted about pivot 141 in the direction indicated by arrow 164. The engagement of gear segments 142 and 152 causes the pivotal movement of gear segment 142 to produce a corresponding pivotal movement of gear segment 152 in the direction indicated by arrow 165. As a result, arms 140 and 150 are pivoted in the directions indicated by arrows 166 and 167 respectively which in turn raises platform 12 (seen in FIG. 22) in response to the upward pivotal movement of the and portions of arms 140 and 150. This, in turn, raises platform 12 to the raised position shown in FIG. 22.

FIG. 22 sets forth a perspective view of game 10 in the fully open configuration having side panel 21 shown in transparency and having side to arms 140 and 150. It will be apparent to those skilled in the art that the above-described mechanism operates in reverse as cover 13 is pivoted upwardly to return game 10 to its closed configuration.

Figure 23:
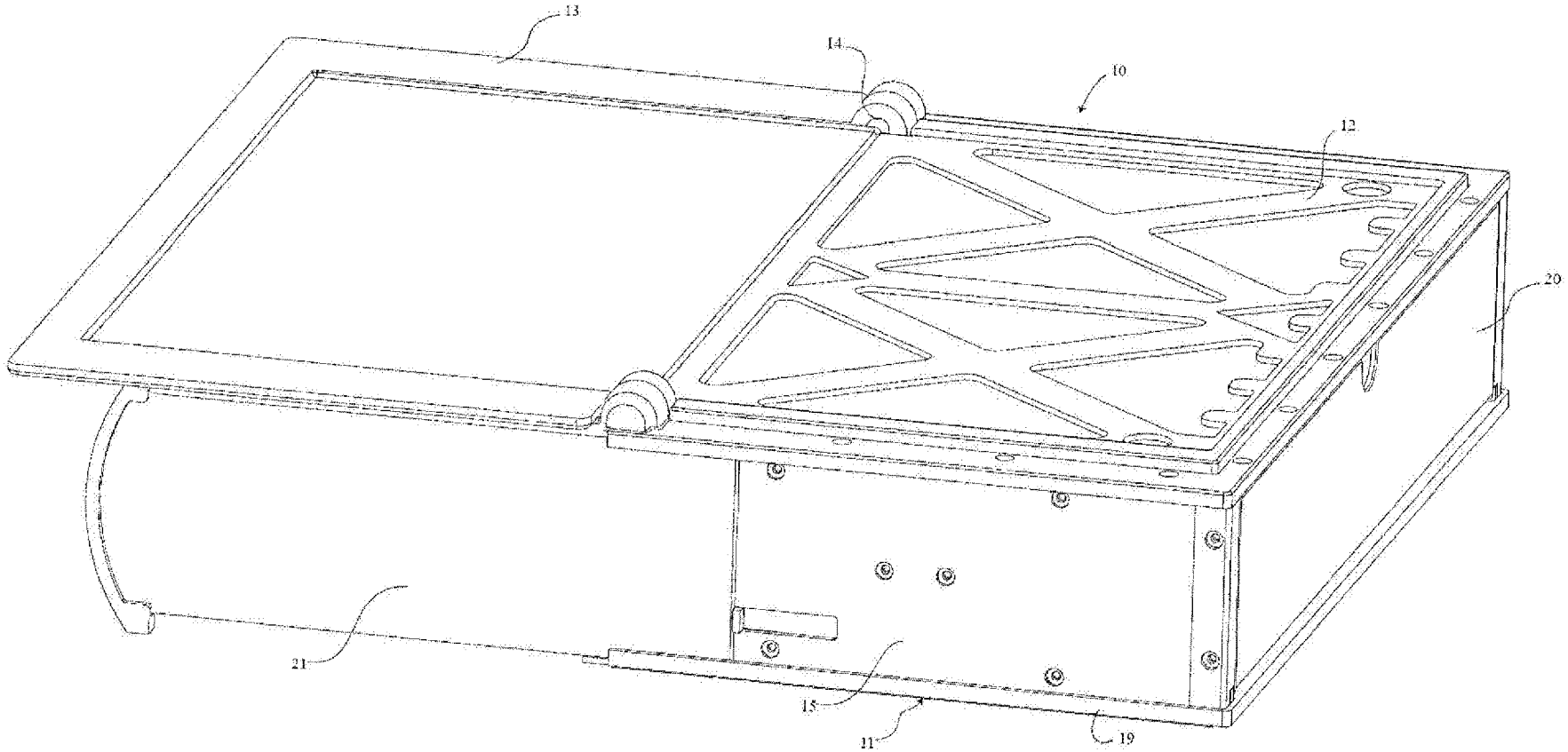
FIG. 23 sets forth a partial perspective view of the embodiment of the variable gaming surface platform shown in FIG. 18D configured in its open game play configuration.

FIG. 23 sets forth a perspective view of game 10 in the open configuration. As can be seen and in accordance with an important aspect of the present invention, cover 13 is supported by side panel 21 and side panel 23 (not shown). As is also seen in FIG. 23 and in further accordance with an important aspect of the present invention, platform 12 has been raised into a position of alignment with cover 13 to provide an extended play surface for game 10.

As mentioned above, FIGS. 24A through 24E set forth sequential perspective figures showing a second embodiment transforming from its closed configuration (FIG. 24A) to its open configuration (FIG. 24E). Accordingly, FIG. 24A sets forth a game generally referenced by numeral 170 having a housing 171, a side panel 172, a front panel 173, a side panel 174 (seen in FIG. 24B) and a cover 175. In the closed configuration shown for game 170 resembles a block.

FIG. 24B sets forth a perspective view of game 170 at an initial step of transforming from the closed configuration to its open configuration. Thus, game 170 includes a housing 171 supporting a pair of side panels 172 and 174 together with a front panel 173. Game 170 further includes a cover 175. Cover 175 is secured by a hinge 176. Side panel 172 is pivotally secured by a hinge 177. Housing 171 further defines an interior within which a platform 183 is movably supported by apparatus set forth below in greater detail. The initial step of transformation of game 170 takes place as cover 175 is pivoted upwardly in the direction indicated by arrow 178. By the operation of apparatus set forth below in greater detail, the upward pivotal movement of cover 175 causes corresponding outward pivotal movement of side panels 172 and 174 in the directions indicated by arrows 179 and 180 respectively. In addition, the pivotal movement of cover 175 also causes front panel 173 to be pivoted downwardly in the direction indicated by arrow 181. As side panels 172 and 174 pivot outwardly, platform 183 is raised.

FIG. 24C sets forth a perspective view of game 170 at an initial step of transforming from the closed configuration to its open configuration. Thus, as described above, game 170 includes a housing 171 supporting a pair of side panels 172 and 174 together with a front panel 173. Game 170 further includes a cover 175. Cover 175 is secured by a hinge 176 side panel 172 is pivotally secured by a hinge 177. Housing 171 further defines an interior 176 within which a platform is movably supported by apparatus set forth below in greater detail. As the upward pivotal movement of cover 175 continues, corresponding outward pivotal movement of side panels 172 and 174 in the directions indicated by arrows 179 and 180 respectively also occur. In addition, the continued pivotal movement of cover 175 also causes front panel 173 to be further pivoted downwardly in the direction indicated by arrow 181. As side panels 172 and 174 pivot outwardly, platform 183 continues to be raised.

FIG. 24D sets forth a perspective view of game 170 near the completion of its transformation from the closed configuration to its open configuration. Thus, as described above, game 170 includes a housing 171 supporting a pair of side panels 172 and 174 together with a front panel 173. Game 170 further includes a cover 175. Cover 175 is secured by a hinge 176 side panel 172 is pivotally secured by a hinge 177. Housing 171 further defines an interior 176 within which a platform is movably supported by apparatus set forth below in greater detail. As the upward pivotal movement of cover 175 nears completion, corresponding rearward pivotal movement of side panels 172 and 174 in the directions indicated by arrows 179 and 180 respectively also occurs. In addition, the continued pivotal movement of cover 175 also causes front panel 173 to be further pivoted downwardly in the direction indicated by arrow 181. As side panels 172 and 174 pivot outwardly, platform 183 continues to be raised.

Finally, in FIG. 24E game 170 has been configured into its open game play configuration. Thus, as described above, game 170 includes a housing 171 supporting a pair of side panels 172 and 174 together with a front panel 173. Game 170 further includes a cover 175. Cover 175 is secured by a pair of hinges 176. Side panel 172 is pivotally secured by a hinge 177. Housing 171 further defines an interior cavity within which a platform 183 is movably supported by apparatus set forth below in greater detail. In the fully open configuration of FIG. 24E, platform 183 has been raised within housing 171 into alignment with cover 175. In addition, cover 175 is supported by side panels 172 and 174 (seen in FIG. 24D). It will be apparent to those skilled in the art that game 170 may be returned to the closed configuration shown in FIG. 24A by essentially reversing the previously described sequential operations.

Figure 25:
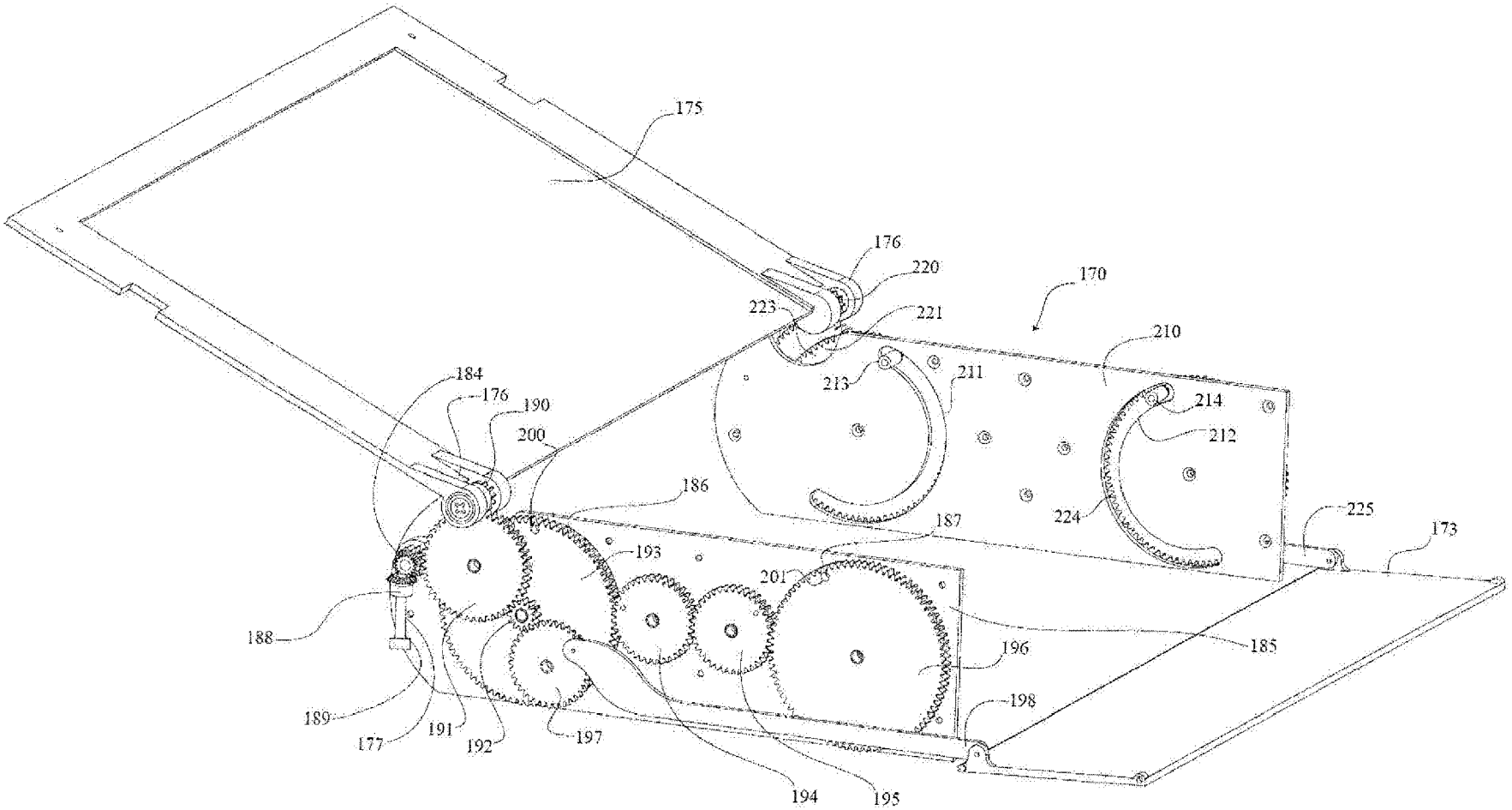
FIG. 25 sets forth a partial perspective view of the embodiment of the variable gaming surface platform shown in FIG. 24D transitioning to its open game play configuration.
Figure 26:
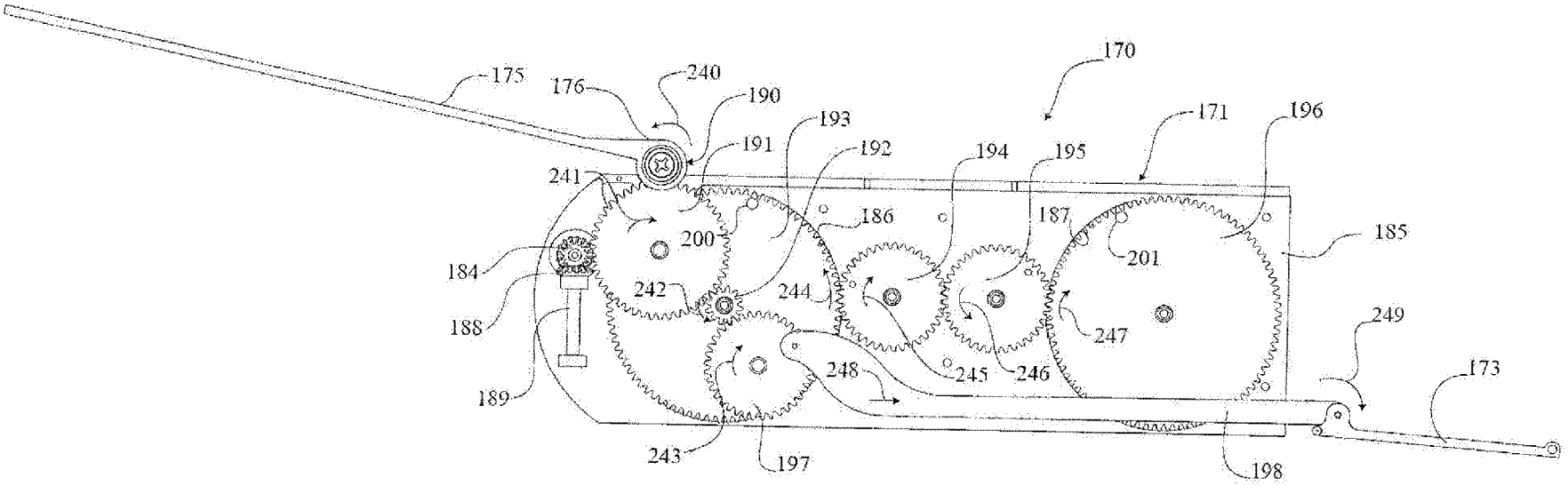
FIG. 26 sets forth an end view of the embodiment of the variable gaming surface platform shown in FIG. 24D transitioning to its open game play configuration.

FIG. 25 sets forth a perspective view of the operational mechanism by which the pivotal movement of cover 175 of game 170 causes platform 183 to be raised and lowered. Concurrently, this mechanism pivots side panels 172 and 174 rearwardly while front panel 173 is pivoted downwardly. Once again, it will be understood that the operative mechanism set forth in FIGS. 25 and 26 is duplicated as a mirror image of the mechanism on the opposite side of housing 171 which is not seen because of the perspective view of housing 171. This operational mechanism will be understood to be virtually identical to the mechanism shown in the following figures. Accordingly, the descriptions and illustrations set forth in FIGS. 25 and 26 will be understood to apply equally well to the mirror image mechanism positioned on the opposite side of housing 171.

More specifically, FIG. 25 sets forth a perspective view of game 170 having most of housing 171 removed to facilitate illustration of the operative mechanism therein. Accordingly, game 170 utilizes a pair of sides 185 and 210 which extend forwardly from the binding portion of the housing. A cover 175 is pivotally supported upon sides 185 and 210 by a pair of hinges 176 each of which supports an internal gear 190 and 220 respectively. Gears 190 and 220 are operative to couple the rotational movement of hinges 176 as cover 175 is pivoted in either direction. Side 210 defines a pair of curved slots 211 and 212 which receive a pair of pins 213 and 214 respectively. In a similar fabrication side 185 defines a pair of curved slots 186 and 187 which are mirror images of slots 211 and 212 formed in side 210. While not seen in FIG. 25, it will be understood that a set of interleaved gears identical to the gears supported upon side 185 are supported upon side 210. This set of gears includes gears 221 and 224. Gear 221 supports a post 213 which extends through curved slot 211 and, in a similar fashion, gear 224 supports a post 214 which extends through curved slot 212. Gears 221 and 224 are supported upon side 210 and correspond to gears 193 and 196 supported upon side 185. The function of posts 213 and 214 is to engage platform 183 (seen in FIG. 24D). In a similar fashion, gears 193 and 196 which are rotatably supported upon side 185 include inwardly extending posts 200 and 201 respectively which extend inwardly through curved slots 186 and 187 to also engage platform 183 (seen in FIG. 20D).

Side 185 supports a gear 191 which engages gear 190 of hinge 176. A compound gear 193 includes a center gear 192 which engages gear 191 and gear 197. The outer portion of gear 193 engages a gear 194 which in turn engages a gear 195. Gear 195 engages gear 196. An elongated link 198 is offset coupled to gear 197 at one end extends forwardly to a pivotal attachment to one edge of front panel 173. In a similar fashion, a link 225 is offset coupled to a corresponding gear (not shown) supported on side 210 and is pivotally coupled to the remaining edge of front panel 173.

A bevel gear 184 is rotatably supported upon side 185. A shaft 189 which forms the hinge shaft of hinge 177 (seen in FIG. 24B) about which side panel 172 pivots, is rotatably supported upon side 185. A bevel gear 188 is joined to the upper end of shaft 189 and engages gear 184. It should be noted that side panel 172 (seen in FIG. 24B) is joined to shaft 189 and is movable therewith. Accordingly, rotation of shaft 189 produces a corresponding pivotal movement of side panel 172. Once again, it will be noted that an identical mechanism supported upon side 210 is operative in response to gear 220 as cover 175 is pivoted. In this manner side panel 174 (seen in FIG. 24B) is also pivoted as cover 175 is opened.

FIG. 26 sets forth a side view of game 170 showing the operative mechanism which transfers the pivotal movement of cover 175 to a pivotal forward movement of front panel 173 and a raised movement of platform 183 (not shown). More specifically, game 170 includes a housing 171 supporting a side 185. A hinge 176 including a gear 190 pivotally supports cover 175. A shaft 189 which supports side panel 172 (seen in FIG. 24B) is rotatably supported upon side 185 and includes a bevel gear 188. A bevel gear 184 engages bevel gear 188. A gear 191 engages gear 190. A compound gear 193 includes a center gear 192 which engages gear 191. A gear 197 engages center gear 192. A gear 194 engages the outer gear of compound gear 193. A gear 195 engages gear 190. A gear 196 engages gear 195. A gear 197 engages center gear 192 of compound gear 193. A link 198 is offset coupled to gear 197 at one end and pivotally coupled to front panel 173 at its remaining end.

In operation, the manner in which the mechanism set forth in FIGS. 25 and 26 operates to configure game 170 from its closed configuration to its open configuration are described in the descriptions which follow. It will be understood by those skilled in the art that the transformation operates the mechanism in essentially the reverse order when cover 175 is closed to transform game 170 from its open configuration to its closed configuration. Accordingly, as cover 175 is pivoted from a closed position to an open position, it pivots about hinge 176 in the direction indicated by arrow 240. This, in turn, rotates gear 190 in the direction also indicated by arrow 240. The rotation of gear 190 imparts a rotation of gear 191 in the direction indicated by arrow 241. The rotation of gear 191, in turn, rotates center gear 192 in the direction indicated by arrow 242 which, in turn, rotates gear 197 in the direction indicated by arrow 243. Correspondingly, the outer gear of compound gear 193 is also rotated in the direction indicated by arrow 240. This rotation, in turn, causes gear 194 to rotate in the direction indicated by arrow 245 which, in turn, causes gear 195 to rotate in the direction indicated by arrow 246. This rotation causes gear 196 to rotate in the direction indicated by arrow 247. As gears 193 and 196 are rotated in the directions indicated by arrows 244 and 247 respectively, posts 200 and 201 are correspondingly moved in the same directions within curved slots 186 and 187. With temporary return to FIG. 25, it will be observed that this upward motion of the posts within the curved slots is operative to raise platform 183 (seen in FIG. 24B) due to the engagement of posts 200, 201, 213 and 214 therewith.

Returning to FIG. 26, the rotation of gear 197 in the direction indicated by arrow 243 causes arm 198 to be moved in the direction indicated by arrow 248. This movement, in turn, pivots front panel 173 downwardly in the direction indicated by arrow 249. In this manner, the entire transformation of game 170 from the closed configuration shown in FIG. 24A to the open game play configuration shown in FIG. 24D is carried forward by simply opening cover 175.

Figure 27B:
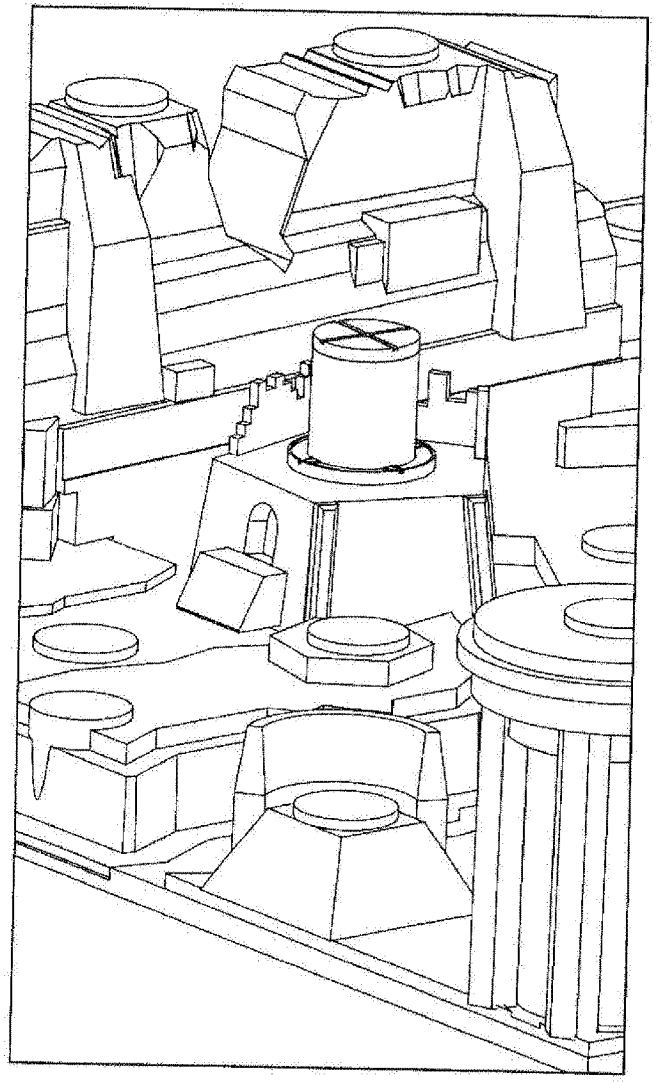
FIGS. 27A, and 27B set forth partial perspective views of a pop-up game marker feature utilized in the present invention variable gaming surface platform.
Figure 27A:
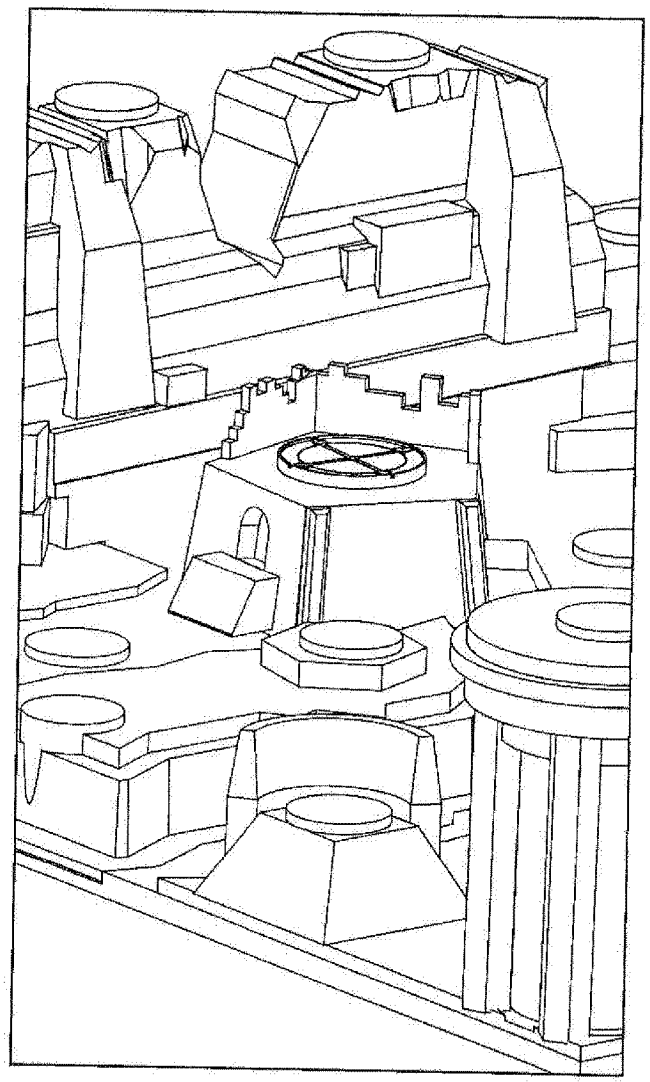

FIGS. 27A and 27B set forth perspective views of an example of a pop-up game play feature utilizing the present invention game surface. It will be apparent to those skilled in the art from the above descriptions that a virtually endless variety of game play and surface features may be utilized in the present invention game without departing from the spirit and scope of the present invention. Of importance to note in FIGS. 27A and 27B is the manner in which a game marker location is transformed to a light play feature by operating a pop-up mechanism at the surface location. It will be understood that for maximum game play excitement the pop-up surface feature is positioned in alignment with an underlying light node in the manner described above.

Figure 30:
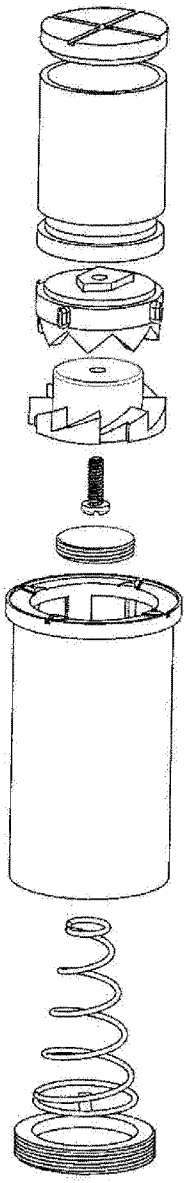
FIGS. 28, 29 and 30 set forth side views of the operative mechanism utilized in the pop-up game marker feature set forth in FIGS. 27A and 27B.
Figure 29:
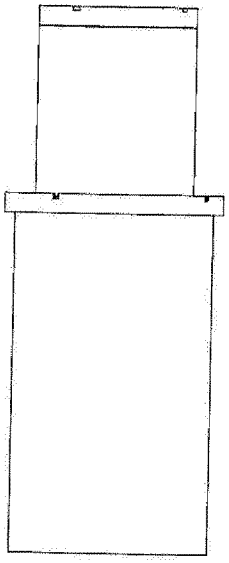
Figure 28:
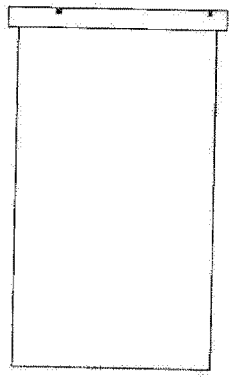

FIGS. 28, 29 and 30 set forth perspective views of the operative mechanism utilized within the pop-up light feature set above in FIGS. 27 and 27B. While a variety of operative mechanisms may be utilized without departing from the spirit and scope of the present invention, the examples set forth utilizes a "Geneva wheel" type mechanism which is characterized by bonding to each downward push by transferring between a pop-up and latch down configuration.

What has been shown is an improved gaming platform which enhances the variety and interest of game play through changeable game play surfaces. The improved game shown may be conveniently configured into a closed configuration for easy transport and storage and may, alternatively, be configured in an open game play configuration in which the game play surface is exposed and configured for play.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A variable surface gaming platform comprising:

a housing defining a housing interior, surrounding sides, a front, a rear and a top, said top being pivotally supported upon said housing and movable between a closed position overlying said interior and an open position exposing said interior;

a first game play platform portion defining a first plurality of projecting game play features supported upon said top;

a second game play platform portion defining a second plurality of projecting game play features within said interior;

game play platform portion support means positioned within said interior supporting said second game play platform portion in a lowered position within said housing interior and a raised position above said housing interior; and game play platform portion movement means operatively coupled to said top and said game play platform portion support means positioning said second game play platform portion within said housing interior when said top is positioned in said closed position and positioning said second game play platform portion above said housing interior when said top is in said open position, said first and second game play platform portions cooperating when said top is in said open position to form a combined game play platform.

2. The variable surface gaming platform set forth in claim 1 wherein said first and second pluralities of projecting game play features are constructed and configured to mutually nest with each other when said top is positioned in said closed position and said second game play platform portion is in its lowered position.

3. The variable surface gaming platform set forth in claim 2 wherein said housing is configured such that said sides, said rear, said front and said top combine to resemble a closed book when said top is in said closed position.

4. The variable surface gaming platform set forth in claim 3 wherein said first and second game play platform portions are supported by respective first and second underlying support bases, said first and second underlying support bases respectively defining first and second pluralities of light source nodes together with respective first and second pluralities of light coupling ribs connected respectively therebetween.

5. The variable surface gaming platform set forth in claim 4 wherein said first and second pluralities of projecting game play features include respective first and second pluralities of light transmissive elements, each of said light transmissive elements being aligned with an underlying light source node.

6. The variable surface gaming platform set forth in claim 5 further including a plurality of game play tokens and wherein said first and second game play platform portions each define pluralities of contoured locations, having directional markers, for receiving said game play tokens during game play.

7. The variable surface gaming platform set forth in claim 6 wherein said first and second pluralities of projecting game play features each include game play features that are sized and located to visually obstruct one or more of said tokens located on said directional markers at said contoured locations.

8. The variable surface gaming platform set forth in claim 4 wherein said first and second game play platform portions each include a selected one of seven types of directional markers at each light source node, said directional markers each defining one or more permissible movement directions for a total of one hundred twelve directions.

9. The variable surface gaming platform set forth in claim 1 wherein said game play platform portion movement means includes:

a hinge pivotally joining said top to said rear of said housing;

a first gear joined to said top;

a pair of pivotally supported arms each having an outer end coupled to said game play platform portion support means and each having a meshed gear segment at their inner ends;

a slide mount supporting said side for sliding motion;

a gear rack supported upon said side;

a slide coupler arm extending from one of said inner ends coupled to said side; and a plurality of coupling gears engaging said first gear and said gear rack.

* * * * *